US009902604B2

(12) United States Patent
Sanchez et al.

(10) Patent No.: US 9,902,604 B2
(45) Date of Patent: Feb. 27, 2018

(54) SINGLE PADDLE ICE AND WATER DISPENSER

(71) Applicant: Electrolux Home Products, Inc., Charlotte, NC (US)

(72) Inventors: Jorge Carlos Montalvo Sanchez, Anderson, SC (US); Thomas W. McCollough, Anderson, SC (US); Nilton Carlos Bertolini, Anderson, SC (US); Travis McMahan, Honea Path, SC (US); Justin Morgan, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 38 days.

(21) Appl. No.: 14/702,907

(22) Filed: May 4, 2015

(65) Prior Publication Data

US 2015/0232315 A1 Aug. 20, 2015

Related U.S. Application Data

(62) Division of application No. 13/709,771, filed on Dec. 10, 2012, now Pat. No. 9,073,743.

(Continued)

(51) Int. Cl.
*B67D 7/80* (2010.01)
*B67D 1/00* (2006.01)

(Continued)

(52) U.S. Cl.
CPC ..... *B67D 1/0014* (2013.01); *B67D 1/0857* (2013.01); *B67D 1/0878* (2013.01);

(Continued)

(58) Field of Classification Search
CPC ..... F25C 2400/10; F25C 5/005; F25C 5/002; F25D 23/126; F25D 25/00; F25D 23/12;

(Continued)

(56) References Cited

U.S. PATENT DOCUMENTS 4,102,660 A 7/1978 Beckett et al.
5,442,993 A 8/1995 Unger (Continued)

FOREIGN PATENT DOCUMENTS

DE 19645018 A1 5/1997
EP 2 333 467 6/2011

(Continued)

OTHER PUBLICATIONS

Translation of Office Action issued in Chinese Patent Application No. 201280068902.8 dated Nov. 18, 2015.

(Continued)

*Primary Examiner* — Lien Ngo
(74) *Attorney, Agent, or Firm* — Pearne & Gordon LLP

(57) ABSTRACT

A dispensing unit is operatively associated with a refrigeration appliance for selectively dispensing water and ice at a dispensing station. The dispensing unit includes an actuator that is movable to selected positions in order to support the dispensing of the water and ice. The dispensing unit can include a passageway through which ice is dispensed, and an ice door can be provided for selectively opening and closing the passageway to the dispensing of ice. In one aspect, the ice door can be opened and closed mechanically and in another aspect, the ice door can be opened and closed electromechanically. The dispensing unit also can provide for the position of a water-dispensing nozzle to be adjusted for the purpose of dispensing water to receptacles outside a recessed area at which the nozzle is located and to provide (Continued)

for the activation of illuminating devices to indicate operating conditions at the refrigeration appliance.

19 Claims, 15 Drawing Sheets

Related U.S. Application Data

(60) Provisional application No. 61/568,953, filed on Dec. 9, 2011, provisional application No. 61/580,785, filed on Dec. 28, 2011.

(51) Int. Cl.

| | |
|---|---|
| ***B67D 1/08*** | (2006.01) |
| ***F25D 25/00*** | (2006.01) |
| ***F25D 23/12*** | (2006.01) |
| ***F21V 33/00*** | (2006.01) |
| *F21W 131/305* | (2006.01) |

(52) U.S. Cl.
CPC ..... *B67D 1/0889* (2013.01); *F21V 33/0044* (2013.01); *F25D 23/12* (2013.01); *F25D 25/00* (2013.01); *F21W 2131/305* (2013.01)

(58) Field of Classification Search
CPC ..... B65D 7/56; B67D 1/0014; B67D 1/0889; B67D 1/0857; B67D 1/0878; F21V 33/0044; F21W 2131/305
USPC ..... 222/146.1, 146, 50, 46; 326/92, 96; 62/334, 389, 353, 264, 244; 141/311 R, 141/360–362
See application file for complete search history.

(56) References Cited

U.S. PATENT DOCUMENTS

| | | | | |
|---|---|---|---|---|
| 5,526,854 | A | 6/1996 | Unger | |
| 5,737,932 | A | 4/1998 | Lee | |
| 6,135,173 | A | 10/2000 | Lee et al. | |
| 6,267,272 | B1 | 7/2001 | Shin | |
| 6,662,577 | B2 | 12/2003 | Goth | |
| 7,007,500 | B2 * | 3/2006 | Lee | F25C 5/005 222/146.6 |
| 7,302,809 | B2 | 12/2007 | Park | |
| 7,445,137 | B2 | 11/2008 | Noh et al. | |
| 7,617,698 | B2 | 11/2009 | Bowen et al. | |
| 7,707,847 | B2 | 5/2010 | David et al. | |
| 7,757,732 | B2 | 7/2010 | Voglewede et al. | |
| 7,793,690 | B2 | 9/2010 | Voglewede et al. | |
| 7,841,493 | B2 | 11/2010 | Park et al. | |
| 7,980,089 | B2 | 7/2011 | Bowen et al. | |
| 8,333,223 | B2 * | 12/2012 | Seo | F25C 5/005 141/104 |
| 2005/0268638 | A1 | 12/2005 | Voglewede | |
| 2006/0237557 | A1 | 10/2006 | Boulter et al. | |
| 2007/0256442 | A1 | 11/2007 | Lyvers et al. | |
| 2008/0041893 | A1 | 2/2008 | Smeltzer | |
| 2008/0156011 | A1 * | 7/2008 | Culley | F25C 5/005 62/228.1 |
| 2008/0156017 | A1 * | 7/2008 | Johnson | F25C 5/005 62/320 |
| 2008/0163641 | A1 | 7/2008 | Mitchell | |
| 2009/0045213 | A1 * | 2/2009 | Dirnberger | F25C 5/005 221/154 |
| 2010/0132835 | A1 * | 6/2010 | Oh | F25D 23/12 141/311 R |
| 2010/0175415 | A1 | 7/2010 | Kim | |
| 2010/0224279 | A1 * | 9/2010 | Chou | F25C 5/002 141/1 |
| 2010/0307184 | A1 | 12/2010 | Jung | |
| 2011/0023524 | A1 | 2/2011 | Roo | |
| 2011/0139817 | A1 | 6/2011 | Lu et al. | |
| 2011/0174008 | A1 | 7/2011 | Kim | |
| 2011/0226815 | A1 * | 9/2011 | Chou | F25C 5/002 222/278 |
| 2011/0259033 | A1 | 10/2011 | Froehlich | |
| 2012/0025418 | A1 | 2/2012 | Lee et al. | |

FOREIGN PATENT DOCUMENTS

| | | | |
|---|---|---|---|
| JP | 3457981 | B2 | 10/2003 |
| WO | 2010/057792 | A3 | 5/2010 |

OTHER PUBLICATIONS

Translation of Search Report issued in Chinese Patent Application No. 201280068902.8 dated Nov. 9, 2015.
International Search Report issued in Application No. PCT/US2012/068767 dated May 2, 2014.
Written Opinion issued in Application No. PCT/US2012/068767 dated May 2, 2014.

* cited by examiner

FIG. 11
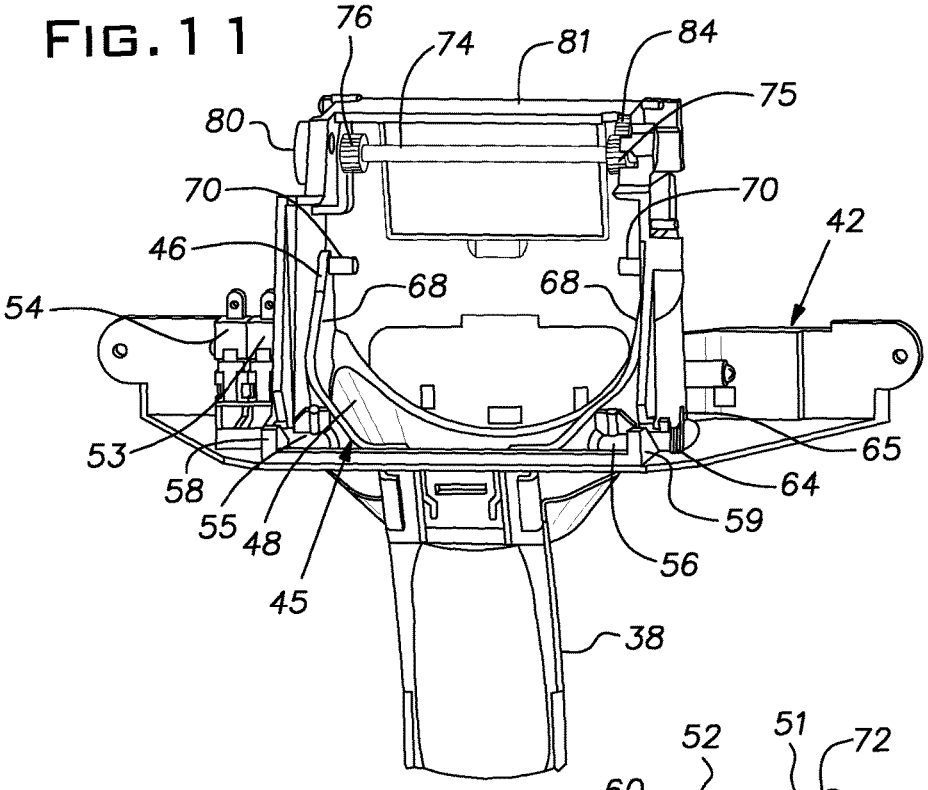
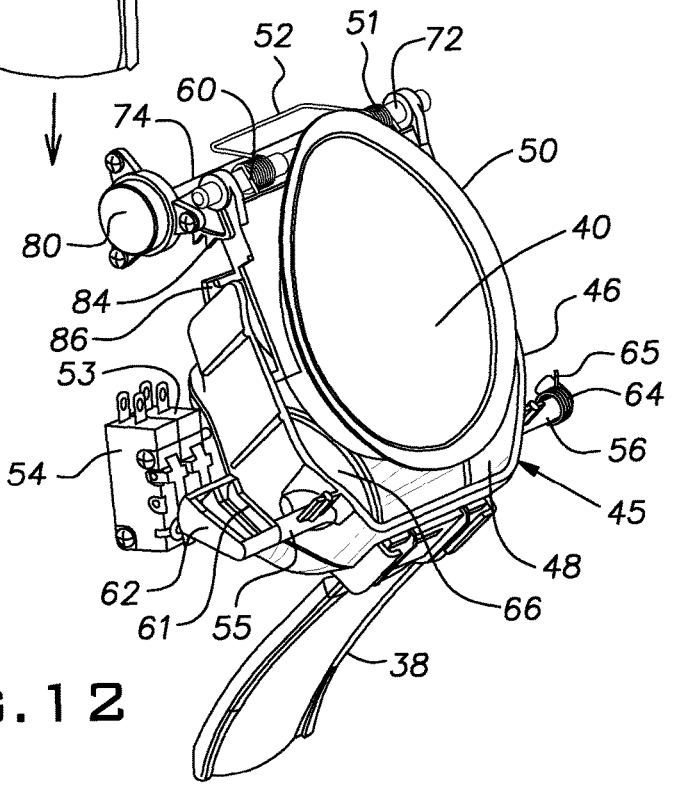
FIG. 12

FIG. 15
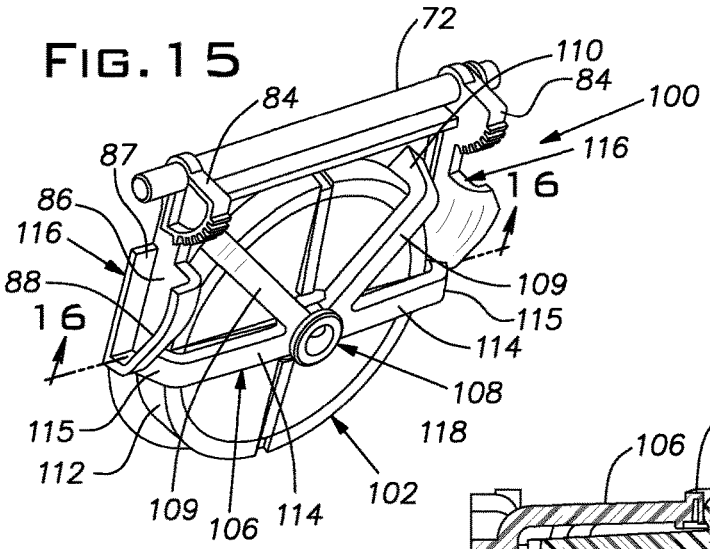
FIG. 16
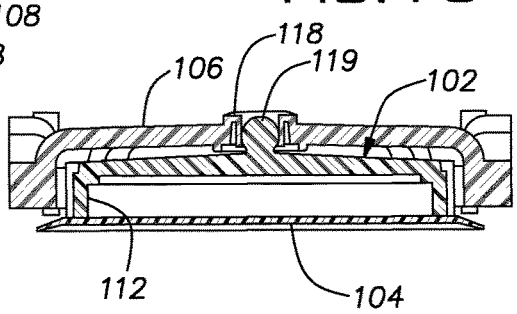
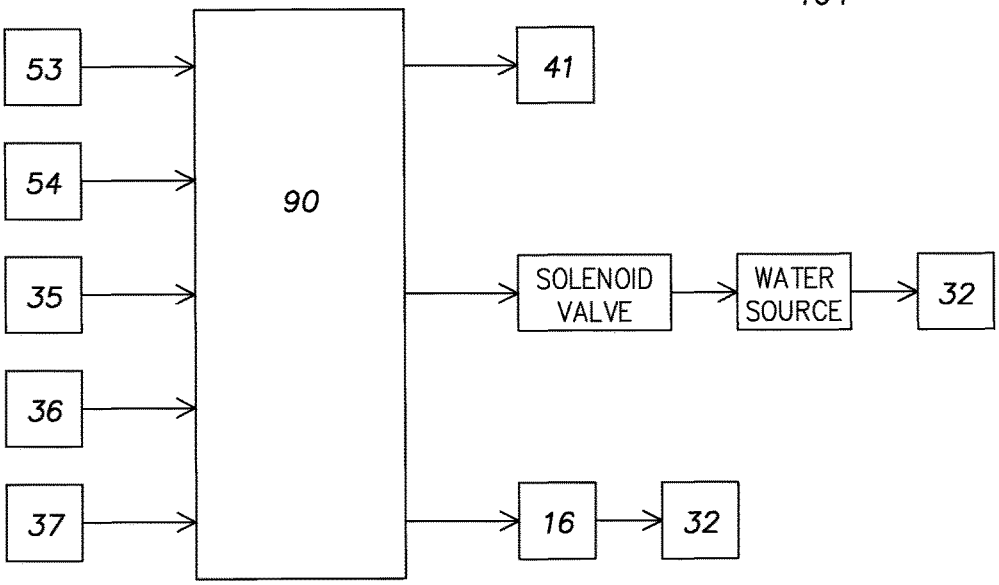
FIG. 17

FIG. 29
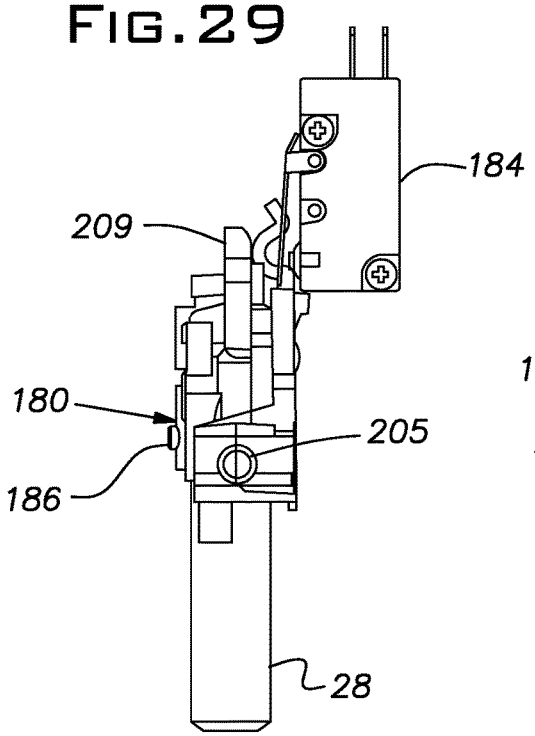
FIG. 30
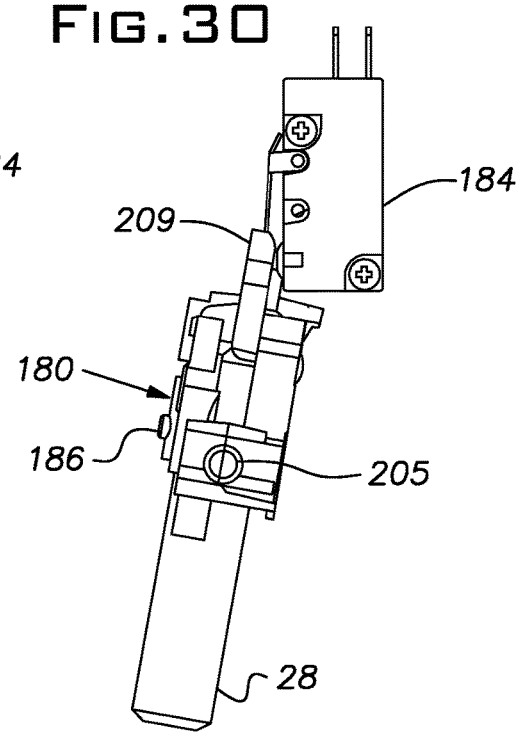
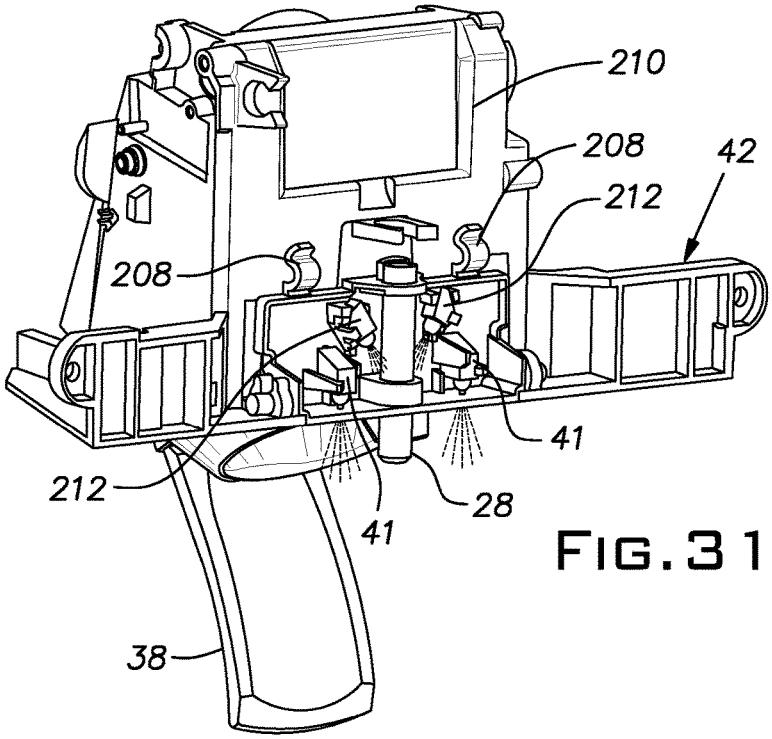
FIG. 31

SINGLE PADDLE ICE AND WATER DISPENSER

CROSS-REFERENCE TO RELATED APPLICATION

This application is a divisional of U.S. application Ser. No. 13/709,771, filed on Dec. 10, 2012, and now U.S. Pat. No. 9,073,743, which claims the benefit of Provisional Application No. 61/568,953, which was filed on Dec. 9, 2011, and Provisional Application No. 61/580,785, which was filed on Dec. 28, 2011. All three of these applications are incorporated by reference herein in their entireties for all purposes.

BACKGROUND OF THE INVENTION

Field of the Invention

The present invention generally concerns ice and water dispensing units and systems for refrigeration appliances, and, in particular, the invention concerns ice and water dispensing units and systems that employ a single paddle operated by a user for dispensing the ice and water.

Discussion of the Prior Art

Refrigeration appliances, such as household refrigerators for example, often are provided with ice and water dispensing systems and units that include dispensing stations at which ice and water can be accessed by users. The dispensing stations can be located at the exteriors of doors that serve to close off the interiors of the refrigeration appliance compartments. In the case of a side-by-side household refrigerator for example, the ice and water dispensing station typically is located at the exterior of the freezer compartment door. On the other hand, in the case of a bottom-mount household refrigerator, that is, a refrigerator in which the freezer compartment is located beneath the fresh food compartment, the ice and water dispensing station typically is located at the exterior of a door at the fresh food compartment.

A variety of mechanisms and arrangements are known for initiating and executing the dispensing of the ice and water from ice-making and ice-storage systems and water sources, respectively, at the dispensing stations of refrigeration appliances. For example, some ice and water dispensing stations include a cavity in the door of the refrigeration appliance and two actuators are mounted in the cavity. One of the actuators causes ice to be dispensed into a receptacle when the receptacle is pressed against the one actuator and the other of the actuators causes water to be dispensed into the receptacle when the receptacle is pressed against the other actuator. In another example, ice and water selection devices such as electrical push buttons or touch screens, for example, are provided at the dispensing station. The ice selection device can be engaged by a user to initiate the delivery of ice to the dispensing station at which the ice can be dispensed into a receptacle that is placed there; and the water selection device can be engaged by a user to initiate the delivery of water to the dispensing station at which the water can be dispensed into a receptacle that is placed there for that purpose. In even other instances, combinations of actuators and selection devices are employed to cause the dispensing of ice and water at the dispensing station.

BRIEF DESCRIPTION OF THE INVENTION

The following sets forth a simplified summary of examples of the present invention for the purpose of providing a basic understanding of selected aspects of the invention. The summary does not constitute an extensive overview of all the aspects or embodiments of the invention. Neither is the summary intended to identify critical aspects or delineate the scope of the invention. The sole purpose of the summary is to present selected aspects of the invention in a simplified form as an introduction to the more detailed description of the embodiments and examples of the invention that follows the summary.

According to a first aspect, a dispensing unit is operatively associated with a refrigeration appliance for selectively dispensing water and ice at a dispensing station at the refrigeration appliance. The dispensing unit can include an actuator that is movable from a first position, at which first position the actuator supports neither the dispensing of water nor the dispensing of ice at the dispensing station, to a second position, at which second position the actuator supports the dispensing of water, and not ice, at the dispensing station. The actuator also can be movable from the first position through the second position to a third position, at which third position the actuator supports the dispensing of ice, and not water, at the dispensing station. The actuator can include a passageway through which ice can be selectively dispensed at the dispensing station. The dispensing unit also can include an ice door closing off the passageway to the dispensing of ice when the actuator is in the first position and in the second position and opening the passageway to the dispensing of ice when the actuator is in the third position. The actuator can be configured to avoid any contact with the ice door that would cause the ice door to open the passageway to the dispensing of ice as the actuator is moved from the first position to the second position and configured to contact the ice door as the actuator is moved from the second position to the third position, thereby causing the ice door to open the passageway to the dispensing of ice.

According to a first embodiment of the first aspect, the dispensing unit can include a water dispensing selector for selecting water to be dispensed at the dispensing station when the actuator is in the second position and the water dispensing selector has been activated. The dispensing unit also can include an ice dispensing selector for selecting ice to be dispensed at the dispensing station when the actuator is in the third position and the ice dispensing selector has been activated.

According to a first example of the first embodiment of the first aspect, the dispensing unit can include a controller that is operably associated with the actuator, the water dispensing selector and the ice dispensing selector and causes water to be dispensed at the dispensing station in response to an input signal indicating the placement of the actuator in the second position and a concurrent signal indicating the activation of the water dispensing selector and ice to be dispensed at the dispensing station in response to an input signal indicating the placement of the actuator in the third position and a concurrent input signal indicating the activation of the ice dispensing selector.

According to a second embodiment of the first aspect, the dispensing unit can include a first actuating device that is engageable by the actuator when the actuator is in the second position and is configured to function in a first operational state that does not support the dispensing of water at the dispensing station when the actuator is in the first position and is configured to function in a second operational state that supports the dispensing of water at the dispensing station when the actuator is in the second position. The dispensing unit also can include a second actuating device that is engageable by the actuator when the actuator is in the third position and is configured to function in a third operational state that does not support the dispensing of ice at the dispensing station when the actuator is in the first position and when the actuator is in the second position and is configured to function in a fourth operational state that supports the dispensing of ice at the dispensing station when the actuator is in the third position.

In a first example of the second embodiment of the first aspect, a lighting system also can be provided. The lighting system can include at least one lighting element and be operably associated with the first actuating device and the controller so that the placement of the first actuating device in the second operational state energizes the lighting element.

According to a third embodiment of the first aspect, the ice door can include at least one slot that includes a first side and a second side and the actuator can include a respective actuating member that is located within the at least one slot at the first side of the at least one slot when the actuator is in the first position, that is located at the second side of the at least one slot when the actuator is in the second position and that is in engagement with the second side of the at least one slot while the actuator is moved from the second position to the third position, thereby causing the ice door to open the passageway to the dispensing of ice.

According to a first example of the third embodiment of the first aspect, the second side of the at least one slot can comprise a curved surface.

According to a fourth embodiment of the first aspect, the ice door can include a flapper that has a seating surface that is configured to seat against the bottom of a chute through which ice is delivered to the passageway. The ice door also can include a flapper supporting member supporting the flapper. The flapper supporting member can be joined to the flapper by a universal adjusting member, whereby the attitude of the flapper can be adjusted as the ice door engages the bottom of the chute so that the seating surface of the flapper seats against the bottom of the chute in a manner essentially entirely closing off the opening at the bottom of the chute to the passage of ice to the passageway.

In a first example of the fourth embodiment of the first aspect, the universal adjusting member can comprise a ball and socket joint.

In a fifth embodiment of the first aspect, the dispensing unit can include a nozzle through which the water is dispensed and at least one illuminating device configured to illuminate the nozzle. Each of the at least one illuminating device can be configured to produce a color light different from the color light produced by the other illuminating devices, wherein each color light represents an operating condition of a separate component of the refrigeration appliance.

In a first example of the fifth embodiment of the first aspect, the refrigeration appliance can include a water filter configured to filter water dispensed at the dispensing unit; and one of the illuminating devices can be operatively associated with the water filter, whereby the illuminating device operatively associated with the water filter is energized when the water filter is in need of being replaced.

In a sixth embodiment of the first aspect, the dispensing unit can include a nozzle located within a recess at the dispensing station and configured to direct a stream of water within the recess. The nozzle can be angularly adjustable from a substantially vertical position within the recess to an inclined position at which the stream of water dispensed by the nozzle is directed towards the front of the recess.

According to a second aspect, a dispensing system can be operatively associated with a refrigeration appliance for selectively dispensing water and ice. The dispensing system can include a dispensing station at which the water and ice are selectively delivered and dispensed. The dispensing system also can include a water delivery system that is operably associated with the refrigeration appliance and the dispensing station and is configured to deliver water from the refrigeration appliance to the dispensing station. In addition, the dispensing system can include an ice delivery system that is operably associated with the refrigeration appliance and the dispensing station and is configured to deliver ice from the refrigeration appliance to the dispensing station. A dispensing unit located at the dispensing station and the dispensing unit can include an actuator that is operably associated with the water delivery system and the ice delivery system and is mounted at the dispensing station for selective movement from a first position to a second position and selective movement from the first position to a third position. When the actuator is in the first position it supports neither the delivery of water by the water delivery system from the refrigeration appliance to the dispensing station nor the dispensing of water at the dispensing station. In addition, when the actuator is in the first position, it can neither support the delivery of ice by the ice delivery system from the refrigeration appliance to the dispensing station nor the dispensing of ice at the dispensing station. However, the actuator when in the second position can support the delivery of water by the water delivery system from the refrigeration appliance to the dispensing station and the dispensing of the water at the dispensing station, and the actuator; and when in the third position the actuator can support the delivery of ice by the ice delivery system from the refrigeration appliance to the dispensing station and the dispensing of ice at the dispensing station. The actuator can include a passageway through which ice selectively delivered by the ice delivery system from the refrigeration appliance to the dispensing station and is dispensed at the dispensing station. The dispensing unit also can include an ice door that is operatively associated with the actuator and closes off the passageway to the dispensing of ice when the actuator is in the first position and in the second position and opens the passageway to the dispensing of ice when the actuator is in the third position. The actuator can be configured to avoid any contact with the ice door that would cause the ice door to open the passageway to the dispensing of ice as the actuator is moved from the first position to the second position and configured to contact the ice door as the actuator is moved from the second position to the third position, thereby causing the ice door to open the passageway to the dispensing of ice.

According to a first embodiment of the second aspect, the dispensing unit can include a water dispensing selector for selecting water to be dispensed at the dispensing station when the actuator is in the second position and the water selector has been activated. The water dispensing selector can be operably associated with the water delivery system and be selectively operable to place the water delivery system in a water-delivery mode. The placement of the water delivery system in the water-delivery mode by the water dispensing selector, together with the placement of the actuator in the second position, can result in the delivery of water by the water delivery system from the refrigeration appliance to the dispensing station. The dispensing unit also can include an ice dispensing selector for selecting ice to be dispensed at the dispensing station when the actuator is in the third position and the ice dispensing selector has been activated. The ice dispensing selector is operably associated with the ice delivery system and is selectively operable to place the ice delivery system in an ice-delivery mode. The placement of the ice delivery system in the ice-delivery mode by the ice dispensing selector, together with the placement of the actuator in the third position, can result in the delivery of ice by the ice delivery system from the refrigeration appliance to the dispensing station.

According to a first example of the first embodiment of the second aspect, the dispensing unit can include a controller that is operably associated with the actuator, the water delivery system, the ice delivery system, the water dispensing selector and the ice dispensing selector. The controller can be configured to control the placement of the water delivery system in the water-delivery mode and the selective delivery of water by the water delivery system from the refrigeration appliance to the dispensing station in response to the placement of the water delivery system in the water-delivery mode, together with the placement of the actuator in the second position. In addition, the controller can be configured to control the placement of the ice delivery system in the ice-delivery mode and the selective delivery of ice by the ice delivery system from the refrigeration appliance to the dispensing station in response to the placement of the ice delivery system in the ice-delivery mode, together with the placement of the actuator in the third position.

According to a second embodiment of the second aspect, the dispensing unit can include a first actuating device that is engageable by the actuator when the actuator is in the third position and is configured to function in a first operational state not supporting the delivery of water by the water delivery system to the dispensing station from the refrigeration appliance nor the dispensing of water at the dispensing station when the actuator is in the first position and is configured to function in a second operational state that supports the delivery of water by the water delivery system to the dispensing station from the refrigeration appliance and the dispensing of water at the dispensing station when the actuator is in the second position. The dispensing unit also can include a second actuating device that is engageable by the actuator and is configured to function in a third operational state not supporting the delivery of ice by the ice delivery system to the dispensing station from the refrigeration appliance nor the dispensing of ice at the dispensing station when the actuator is in the first position and in the second position and is configured to function in a fourth operational state that supports the delivery of ice by the ice delivery system to the dispensing station from the refrigeration appliance and the dispensing of ice at the dispensing station when the actuator is in the third position.

In a first example of the second embodiment of the second aspect, the dispensing system can include a lighting system including at least one lighting element. The lighting system can be operably associated with the first actuating device and the controller so that the placement of the first actuating device in the second operational state energizes the lighting element.

In a third embodiment of the second aspect, the dispensing unit can include a nozzle through which the water is dispensed and at least one illuminating device configured to illuminate the nozzle. Each of the at least one illuminating device can be configured to produce a color light different from the color light produced by the other illuminating devices, wherein each color light represents an operating condition of a separate component of the refrigeration appliance.

In a first example of the third embodiment of the second aspect, the refrigeration appliance can include a water filter configured to filter water dispensed at the dispensing unit; and one of the illuminating devices can be operatively associated with the water filter, whereby the illuminating device operatively associated with the water filter is energized when the water filter is in need of being replaced.

According to a third aspect, a dispensing system can be operatively associated with a refrigeration appliance for selectively dispensing water and ice and the dispensing system can include a dispensing station at which the water and ice are selectively delivered and dispensed. The dispensing system can include a water delivery system that is operably associated with the refrigeration appliance and the dispensing station and is configured to deliver water from the refrigeration appliance to the dispensing station. In addition, the dispensing system can include an ice delivery system that is operably associated with the refrigeration appliance and the dispensing station and is configured to deliver ice from the refrigeration appliance to the dispensing station. Also, the dispensing system can include a dispensing unit located at the dispensing station and the dispensing unit can include an actuator that is mounted at the dispensing station for selective movement from a first position to a second position in which the second position supports the delivery of water by the water delivery system from the refrigeration appliance to the dispensing station, and for selective movement from the first position through the second position to a third position in which the third position supports the delivery of ice by the ice delivery system from the refrigeration appliance to the dispensing station. The actuator can include a passageway through which ice can be selectively delivered to and dispensed at the dispensing station. The dispensing unit also can include an ice door that closes off the passageway to the dispensing of ice when the actuator is in the first position and in the second position and opens the passageway to the dispensing of ice when the actuator is in the third position. The actuator can be configured to avoid any contact with the ice door as would cause the ice door to open the passageway to the dispensing of ice as the actuator is moved from the first position to the second position and configured to contact the ice door when the actuator is moved from the second position to the third position, thereby causing the ice door to open the passageway to the dispensing of ice. The dispensing unit also can include a first actuating device that is engageable by the actuator for activation by the placement of the actuator in the second position and is operably associated with the water delivery system for placing the water delivery system in a mode to support the delivery of water by the water delivery system from the refrigeration appliance to the dispensing station upon activation of the first actuating device. The dispensing unit can further include a second actuating device that is engageable by the actuator for activation by the placement of the actuator in the third position and is operably associated with the ice delivery system for placing the ice delivery system in a mode to support the delivery of ice by the ice delivery system from the refrigeration appliance to the dispensing station upon activation of the second actuating device.

In a first embodiment of the third aspect, a lighting system can be provided and the lighting system can include at least one lighting element. The lighting system can be operably associated with the first actuating device and the controller so that the placement of the actuator in the second position energizes the at least one lighting element.

In a second embodiment of the third aspect, the dispensing unit can include a nozzle through which the water is dispensed and at least one illuminating device configured to illuminate the nozzle. Each of the at least one illuminating device can be configured to produce a color light different from the color light produced by the other illuminating devices, with each color light representing an operating condition of a separate component of the refrigeration appliance.

In a first example of the second embodiment of the third aspect, the refrigeration appliance can include a water filter that is configured to filter water dispensed at the dispensing unit; and one of the illuminating devices can be operatively associated with the water filter, whereby the illuminating device operatively associated with the water filter is energized when the water filter is in need of being replaced.

In a fourth aspect, a dispensing unit can be operatively associated with a refrigeration appliance for selectively dispensing water and ice at a dispensing station at the refrigeration appliance. The dispensing unit can include an actuator that is movable from a first position, at which first position the actuator supports neither the dispensing of water nor the dispensing of ice at the dispensing station, to a second position, at which second position the actuator supports the dispensing selectively of water and ice at the dispensing station. The actuator can include a passageway through which ice can be dispensed at the dispensing station when the actuator is in the second position ad ice has been selected to be dispensed. The dispensing unit also can include an ice door closing off the passageway to the dispensing of ice when the actuator is in the first position and opening the passageway to the dispensing of ice when the actuator is in the second position and ice has been selected to be dispensed. An electric motor can be provided so as to be operatively associated with the ice door and configured to cause the ice door to open the passageway to the dispensing of ice whenever the actuator is in the second position and ice has been selected to be dispensed at the dispensing station.

In a first embodiment of the fourth aspect, the ice door can include an ice door supporting member. A portion of the ice door supporting member can be configured to engage a driving element of the motor so as to cause the ice door support member to selectively move the ice door between a closed position closing off the passageway to the dispensing of ice when the actuator is in the first position and in the second position and an open position opening the passageway to the dispensing of ice when the actuator is in the third position.

In a first example of the first embodiment of the fourth aspect, the ice door can include a flapper that has a seating surface that is configured to seat against the bottom of a chute through which ice is delivered to the passageway. The ice door also can include a flapper supporting member supporting the flapper. The flapper supporting member can be joined to the flapper by a universal adjusting member, whereby the attitude of the flapper can be adjusted as the ice door engages the bottom of the chute so that the seating surface of the flapper seats against the bottom of the chute in a manner essentially entirely closing off the opening at the bottom of the chute to the passage of ice to the passageway. In a first mode of this first example, the universal adjusting member can comprise a ball and socket joint.

In a second embodiment of the fourth aspect, a water dispensing selector can be included for selecting water to be dispensed at the dispensing station when the actuator is in the second position and the water dispensing selector has been activated. Also, an ice dispensing selector can be included for selecting ice to be dispensed at the dispensing station when the actuator is in the second position and the ice dispensing selector has been activated.

In a first example of the second embodiment of the fourth aspect, the dispensing unit can include a controller that is operably associated with the actuator, the water dispensing selector and the ice dispensing selector. The controller can cause the water to be dispensed at the dispensing station in response to an input signal indicating the placement of the actuator in the second position and a concurrent input signal indicating the activation of the water dispensing selector. The controller also can cause ice to be dispensed at the dispensing station in response to an input signal indicating the placement of the actuator in the second position and a concurrent input signal indicating the activation of the ice dispensing selector. In a first mode of this first example, the dispensing unit can include a lighting system including a lighting element, and the lighting system can be operably associated with the actuator so that the placement of the actuator in the first position energizes the lighting element.

In a third embodiment of the fourth aspect, the dispensing unit can include a nozzle through which the water is dispensed and at least one illuminating device configured to illuminate the nozzle. Each of the at least one illuminating device can be configured to produce a color light different from the color light produced by the other illuminating devices with each color light representing an operating condition of a separate component of the refrigeration appliance.

In a first example of the third embodiment of the fourth aspect, the refrigeration appliance can include a water filter that is configured to filter water dispensed at the dispensing unit. One of the illuminating devices can be operatively associated with the water filter, whereby the illuminating device operatively associated with the water filter is energized when the water filter is in need of being replaced.

In a fourth embodiment of fourth aspect, the dispensing unit can include a nozzle that is configured to direct a stream of the water from a source of the water to a receptacle placed at the dispensing station, wherein the nozzle is movable between a refracted position and an extended position at the dispensing unit.

In a first example of the fourth embodiment of the fourth aspect, the nozzle can be located within a recess at the dispensing station and be angularly adjustable from a substantially vertical position within the recess to an inclined position at which the stream of water dispensed by the nozzle is directed towards the front of the recess. In a first mode of this first example, the dispensing unit can include a supporting structure for the nozzle and an actuating device configured to activate the delivery of the water to the nozzle. The actuating device can be operatively associated with the supporting structure, whereby the supporting structure is configured to activate the actuating device when the nozzle is placed in the inclined position. And in a first type of this first mode, the nozzle can be releasably attachable to the supporting structure.

In a fifth embodiment of the fourth aspect, the dispensing unit can include a water and ice actuating device that is engageable by the actuator when the actuator is in the second position. The water and ice actuating device can support the dispensing of water at the dispensing station and the dispensing of ice at the dispensing station when the actuator is in the second position.

In a fifth aspect, a dispensing system operatively associated with a refrigeration appliance for selectively dispensing water and ice can include a dispensing station at which the water and ice are selectively delivered and dispensed; a water delivery system operably associated with the refrigeration appliance and the dispensing station and configured to deliver water from the refrigeration appliance to the dispensing station; an ice delivery system operably associated with the refrigeration appliance and the dispensing station and configured to deliver ice from the refrigeration appliance to the dispensing station; and a dispensing unit located at the dispensing station. The dispensing unit can include an actuator that is operably associated with the water delivery system and the ice delivery system and is mounted at the dispensing station for selective movement from a first position to a second position. The actuator when in the first position would support neither the delivery of water by the water delivery system from the refrigeration appliance to the dispensing station nor the dispensing of water at the dispensing station nor would the actuator support the delivery of ice by the ice delivery system from the refrigeration appliance to the dispensing station or the dispensing of ice at the dispensing station. The actuator when in the second position would support the delivery of water by the water delivery system from the refrigeration appliance to the dispensing station and the dispensing of the water at the dispensing station; and the actuator when in the second position would support the delivery of ice by the ice delivery system from the refrigeration appliance to the dispensing station and the dispensing of ice at the dispensing station. The actuator can include a passageway through which ice selectively delivered by the ice delivery system from the refrigeration appliance to the dispensing station is dispensed at the dispensing station. The dispensing unit also can include an ice door that is operatively associated with the actuator and closes off the passageway to the dispensing of ice when the actuator is in the first position and when the actuator is in the second position and ice has not been selected to be dispensed and opens the passageway to the dispensing of ice when the actuator is in the second position and ice has been selected to be dispensed. An electric motor can be provided so as to be operatively associated with the ice door and configured to cause the ice door to open the passageway to the dispensing of ice whenever the actuator is in the second position and ice has been selected to be dispensed at the dispensing station and to close the passageway to the dispensing of ice whenever the actuator is in the first position and whenever the actuator is in the second position and ice has not been selected to be dispensed at the dispensing station.

In a first embodiment of the fifth aspect, the dispensing unit can include a water dispensing selector for selecting water to be dispensed at the dispensing station when the actuator is in the second position and the water dispensing selector has been activated. The water dispensing selector can be operably associated with the water delivery system and be selectively operable to place the water delivery system in a water-delivery mode. The placement of the water delivery system in the water-delivery mode by the water dispensing selector, together with the placement of the actuator in the second position, can result in the delivery of water by the water delivery system from the refrigeration appliance to the dispensing station. The dispensing unit also can include an ice dispensing selector for selecting ice to be dispensed at the dispensing station when the actuator is in the second position and the ice dispensing selector has been activated. The ice dispensing selector can be operably associated with the ice delivery system and be selectively operable to place the ice delivery system in an ice-delivery mode. The placement of the ice delivery system in the ice-delivery mode by the ice dispensing selector, together with the placement of the actuator in the second position, can result in the delivery of ice by the ice delivery system from the refrigeration appliance to the dispensing station.

In a second embodiment of the fifth aspect, the dispensing unit can include a nozzle through which the water is dispensed and at least one illuminating device configured to illuminate the nozzle. Each of the at least one illuminating device can be configured to produce a color light different from the color light produced by the other illuminating devices. Each color light can represent an operating condition of a separate component of the refrigeration appliance.

In a first example of the second embodiment of the fifth aspect, the refrigeration appliance can include a water filter that is configured to filter water dispensed at the dispensing unit. One of the illuminating devices can be operatively associated with the water filter, whereby the illuminating device operatively associated with the water filter is energized when the water filter is in need of being replaced.

In a third embodiment of the fifth aspect, the dispensing system can include an actuating device that is operably associated with the water delivery system for placing the water delivery system in a mode to support the delivery of water by the water delivery system from the refrigeration appliance to the dispensing station. The actuating device also can be operably associated with the ice delivery system for placing the ice delivery system in a mode to support the delivery of ice by the ice delivery system from the refrigeration appliance to the dispensing station.

According to a sixth aspect, a dispensing system operatively associated with a refrigeration appliance for selectively dispensing water and ice can include a dispensing station at which the water and ice are selectively delivered and dispensed; a water delivery system operably associated with the refrigeration appliance and the dispensing station and configured to deliver water from the refrigeration appliance to the dispensing station; an ice delivery system operably associated with the refrigeration appliance and the dispensing station and configured to deliver ice from the refrigeration appliance to the dispensing station; and a dispensing unit located at the dispensing station. The dispensing unit can include an actuator mounted at the dispensing station for selective movement from a first position to a second position, the second position supporting the delivery selectively of water by the water delivery system from the refrigeration appliance to the dispensing station and ice by the ice delivery system from the refrigeration appliance to the dispensing station. The actuator can include a passageway through which ice can be selectively delivered to and dispensed at the dispensing station. The dispensing unit also can include an ice door that closes off the passageway to the dispensing of ice when the actuator is in the first position and when the actuator is in the second position and ice has not been selected to be dispensed and opens the passageway to the dispensing of ice when the actuator is in the second position and ice has been selected to be dispensed. An electric motor can be provided in operative association with the ice door. The electric motor can be configured to cause the ice door to open the passageway to the dispensing of ice whenever the actuator is in the second position and ice has been selected to be dispensed at the dispensing station and to close the passageway to the dispensing of ice whenever the actuator is in the first position and whenever the actuator is in the second position and ice has not been selected to be dispensed at the dispensing station. In addition a water and ice actuating device can be provided that is engageable by the actuator for activation by the placement of the actuator in the second position. The water and ice actuating device can be operably associated with the water delivery system for placing the water delivery system in a mode to support the delivery of water by the water delivery system from the refrigeration appliance to the dispensing station upon activation of the actuating device. The water and ice actuating device also can be operably associated with the ice delivery system for placing the ice delivery system in a mode to support the delivery of ice by the ice delivery system from the refrigeration appliance to the dispensing station upon activation of the actuating device.

In a first embodiment of the sixth aspect, the dispensing unit can include a water dispensing selector that is operably associated with the water delivery system and is selectively operable upon activation to place the water delivery system in a water-delivery mode. The placement of the water delivery system in the water-delivery mode by the water dispensing selector, together with the placement of the actuator in the second position, would result in the delivery of water by the water delivery system from the refrigeration appliance to the dispensing station and the dispensing of the water at the dispensing station. The dispensing unit also can include an ice dispensing selector that is operably associated with the ice delivery system and is selectively operable upon activation to place the ice delivery system in an ice-delivery mode. The placement of the ice delivery system in the ice-delivery mode by the ice dispensing selector, together with the placement of the actuator in the second position, would result in the delivery of ice by the ice delivery system from the refrigeration appliance to the dispensing station and the dispensing of ice at the dispensing station.

In a second embodiment of the sixth aspect, the dispensing unit can include a nozzle through which the water is dispensed and at least one illuminating device configured to illuminate the nozzle. Each of the at least one illuminating device can be configured to produce a color light different from the color light produced by the other illuminating devices. Each color light can represent an operating condition of a separate component of the refrigeration appliance.

In a first example of the second embodiment of the sixth aspect, the refrigeration appliance can include a water filter that is configured to filter water dispensed at the dispensing unit. One of the illuminating devices can be operatively associated with the water filter, whereby the illuminating device operatively associated with the water filter is energized when the water filter is in need of being replaced.

According to a seventh aspect, a dispensing unit can be operatively associated with a refrigeration appliance for dispensing water at a dispensing station at the refrigeration appliance. The dispensing unit can include a nozzle that is configured to direct a stream of the water from a source of the water to a receptacle placed at the dispensing station, wherein the nozzle is movable between a retracted position and an extended position at the dispensing unit.

In a first embodiment of the seventh aspect, the nozzle can be located within a recess at the dispensing station and be angularly adjustable from a substantially vertical position within the recess to an inclined position at which the stream of water dispensed by the nozzle is directed towards the front of the recess.

In a first example of the first embodiment of the seventh aspect, the dispensing unit can include a supporting structure for the nozzle and an actuating device that is configured to activate the delivery of the water to the nozzle. The actuating device can be operatively associated with the supporting structure, whereby the supporting structure is configured to activate the actuating device when the nozzle is placed in the inclined position. In a first mode of this first example, the nozzle can be releasably attachable to the supporting structure. In one type of this first mode, the dispensing unit can include at least two illuminating devices configured to illuminate the nozzle. Each of the at least two illuminating devices can be configured to produce a color light different from the color light produced by the other illuminating devices. Each color light can represent an operating condition of a separate component of the refrigeration appliance such as, for example, whether a water filter at the refrigeration appliance is in need of replacement.

Any one of the aspects, embodiments, examples, modes, forms or types described above not only can be provided alone, but also can be provided in combination with one or more of the other aspects, embodiments, examples, modes, forms or types.

BRIEF DESCRIPTION OF THE DRAWINGS

The foregoing and other aspects of the present invention will be apparent to those skilled in the art to which the present invention relates from the detailed descriptions of examples of aspects and embodiments of the invention that follow with reference to the accompanying drawings, wherein the same reference numerals are used in the several figures to refer to the same parts or elements and in which:

FIG. 11 is a perspective view of a first subassembly of the dispensing unit of FIG. 9, wherein the first subassembly is illustrated in a condition that supports neither the dispensing of water nor the dispensing of ice;

FIG. 12 is a perspective view of a second subassembly of the dispensing unit of FIG. 9, wherein the second subassembly is illustrated in a condition that supports neither the dispensing of water nor the dispensing of ice;

FIG. 15 is a perspective view of an embodiment of an ice door that can be employed with the first aspect of a dispensing station according to the invention;

FIG. 16 is a cross-sectional view along the cross-sectional line 16-16 of FIG. 15;

FIG. 17 is a schematic presentation of certain control features and elements applicable to the first aspect of the present invention.

FIGS. 29 and 30 are side elevational views of the water-dispensing nozzle of FIG. 24 illustrating the nozzle in several operational states;

FIG. 31 is a perspective view of an aspect of the invention that relates in particular to the use of lighting elements with a dispensing unit.

DETAILED DESCRIPTION

Examples of embodiments that incorporate one or more aspects of the present invention are described below with references, in certain respects, to the accompanying drawings. These examples are not intended to be limitations on the present invention. Thus, for example, in some instances, one or more examples of the present invention described with reference to one aspect or embodiment can be utilized in other aspects and embodiments. In addition, certain terminology is used herein for convenience only and is not to be taken as limiting the present invention.

Figure 1:
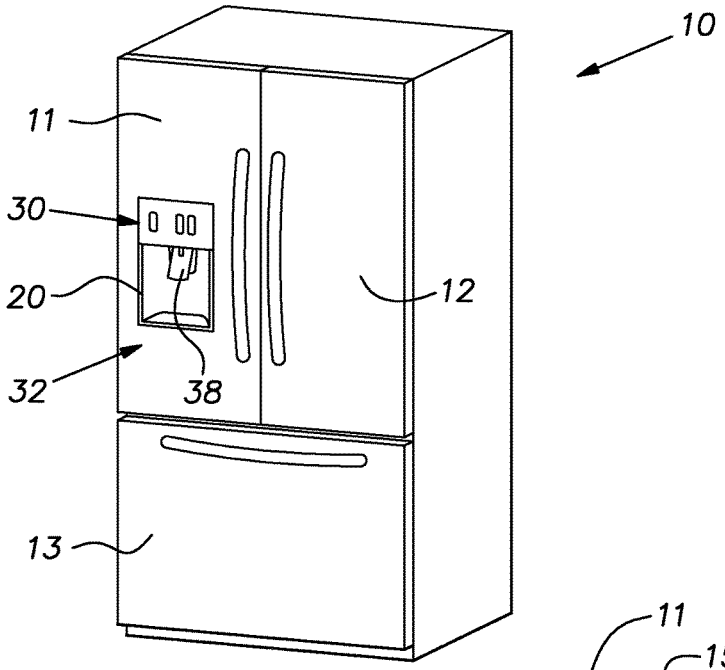
FIG. 1 is a schematic perspective view of a refrigeration appliance that incorporates the present invention.

FIGS. 1 through 4 of the accompanying drawings constitute somewhat schematic illustrations of an embodiment of a water and ice dispensing system, including a dispensing station and a dispensing unit, that is operatively associated with a refrigeration appliance for selectively delivering water and ice to the dispensing station and dispensing at the dispensing station of the refrigeration appliance the water or ice that has been selected. In FIG. 1, according to an example of the invention, a dispensing unit, indicated generally at 30, is installed at a dispensing station for water and ice, indicated generally at 32, of a refrigeration appliance, indicated generally at 10. In FIG. 1, the dispensing system, including the dispensing unit 30 and the dispensing station 32, is shown as applied to a bottom-mount household refrigerator. However, the invention is not limited to being employed with a bottom-mount household refrigerator and, as will become more apparent from the detailed description that follows, can be employed with other types of refrigeration appliances from which water and ice are dispensed, such as side-by-side refrigerators for example.

The refrigeration appliance 10 of FIG. 1 includes both a fresh food compartment, access to which is had by means of a first fresh food compartment door 11 and a second fresh food compartment door 12 that are pivotally hinged at the sides of the refrigerator, and a freezer compartment, access to which is had by means of pull-out drawer attached to freezer compartment door 13. In the example of FIG. 1, the dispensing unit 30 is shown as being located at an access opening 20 in a front panel of the first fresh food compartment door 11. However, as noted, the dispensing system, including the dispensing unit 30 and the dispensing station 32, of the invention can be employed with other types of refrigeration appliances in which case the dispensing system, the dispensing unit 30 and the dispensing station 32 can be located in other settings. For example, in a side-by-side household refrigerator in which the freezer compartment is located alongside the fresh food compartment, the dispensing station and the dispensing unit of the invention can be located at an outer panel of the door of the freezer compartment.

Figure 2:
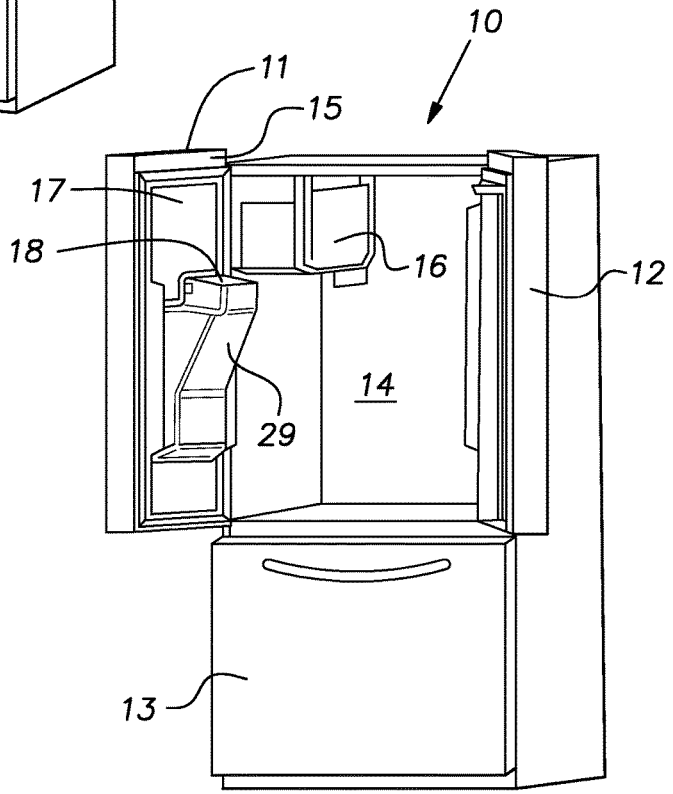
FIG. 2 is a schematic perspective view of the refrigeration appliance of FIG. 1 wherein the interior of a portion of the appliance is shown.

In FIG. 2, the first fresh food compartment door 11 and the second fresh food compartment door 12 of the refrigeration appliance 10 are shown in an open condition so that an interior of the fresh food compartment 14 and an interior facing or surface 15 of the first fresh food compartment door 11 are visible. An ice maker 16 is located at a top of the interior of the fresh food compartment 14 and at a side of the interior of the fresh food compartment that is adjacent the first fresh food compartment door 11. A housing, indicated generally at 17, which houses the dispensing unit 30, is located at the interior facing 15 of the first fresh food compartment door 11. The housing 17 includes a housing opening 18 that is aligned with a discharge point for ice delivered from the ice maker 16 when the first fresh food compartment door 11 is closed. The housing opening 18 opens to a chute, not shown in FIG. 2 but described below, that delivers ice from the discharge point of the ice maker 16 to the dispensing unit 30 at the dispensing station 32.

FIGS. 3 through 8 illustrate in more detail an example of the general arrangement, with respect to one another, of the first fresh food compartment door 11, the dispensing station 32, the dispensing unit 30 and the housing 17 among other elements. Each of these figures represents a view of a portion of the first fresh food compartment door 11 that includes the dispensing station 32 and the dispensing unit 30.

Figure 3:
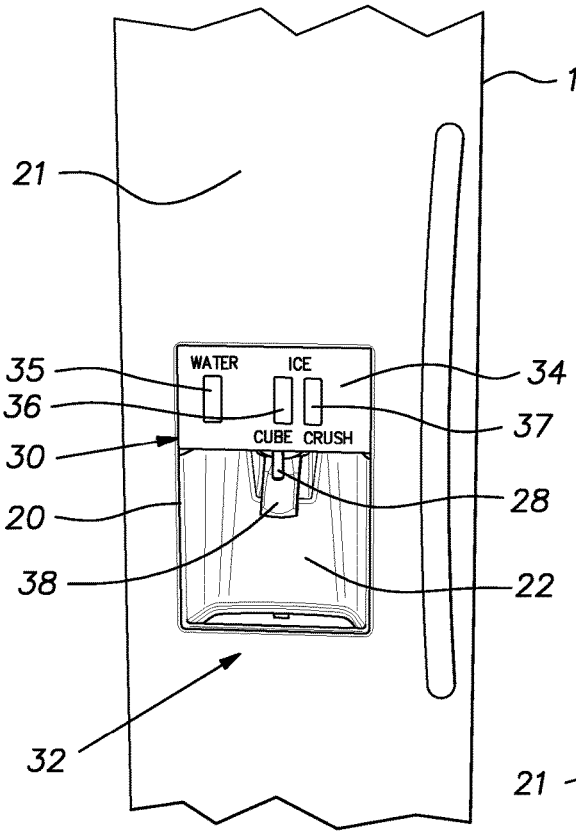
FIG. 3 is a front elevational view of a portion of the refrigeration appliance of FIG. 1 that incorporates aspects of the invention.

With reference to FIG. 3, the dispensing unit 30 is shown as being mounted at the dispensing station 32 at which both ice and water can be dispensed. The dispensing station 32 is located at the access opening 20 in a front panel 21 of first fresh food compartment door 11 and is recessed inwardly of the front panel 21 so as to form a recess 22. Receptacles such as glasses may be inserted into the recess 22 for receiving water through a nozzle 28 from a water delivery system described below and for receiving ice delivered from an ice delivery system, also described below, and dispensed at the dispensing station 32 by the operation of the dispensing unit 30. A panel 34 located at the top of the dispensing station 32 comprises a user interface that includes dispensing selector buttons that are located at the panel and form a part of the dispensing unit 30 in the example of FIG. 3. In that example, a water dispensing selector 35 in the form of a push button is provided for activation by a user whenever water is selected to be dispensed at the dispensing station 32 and ice dispensing selectors are provided for activation by a user whenever ice is selected to be dispensed at the dispensing station 32. Cubed ice dispensing selector 36 is selected whenever cubed ice is to be dispensed and crushed ice dispensing selector 37 is selected whenever crushed ice is to be dispensed. As described in greater detail below, in the first aspect of the invention illustrated in the drawings, it is not the activation of the water dispensing selector 35 alone or the activation of the cubed ice dispensing selector 36 alone or the crushed ice dispensing selector 37 alone that causes the water and the ice, respectively, to be dispensed. Rather, it is the selective activation of the water dispensing selector 35 together with the insertion of a receptacle into the recess 22 a first distance to receive water that causes the dispensing of the water and it is the selective activation of cubed ice dispensing selector 36 together with the insertion of the receptacle into the recess 22 a second distance to receive cubed ice that causes cubed ice to be dispensed at the dispensing station 32. And it is the selective activation of crushed ice dispensing selector 37 together with the insertion of the receptacle into the recess 22 the second distance to receive crushed ice that causes crushed ice to be dispensed at the dispensing station 32.

According to the first aspect of the invention, the insertion of a receptacle into the recess 22 the first distance advances a paddle 38, that forms a portion of an actuator included in the dispensing unit 30 and described below, toward the rear of the recess 22 to a position that supports the delivery and dispensing of water through nozzle 28 at the dispensing station 32. And the insertion of a receptacle into the recess 22 the second distance advances the paddle 38 further toward the rear of the recess 22 to a position that supports the delivery and dispensing of ice at the dispensing station 32.

Figure 4:
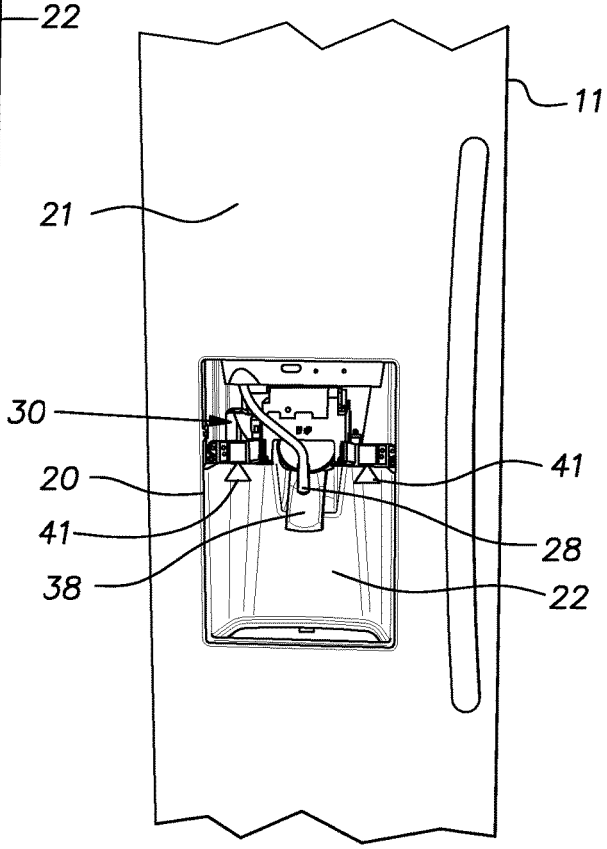
FIG. 4 is a front elevational view of the portion of the refrigeration appliance of FIG. 3 with certain exposed elements of the invention not shown for the purpose of more clearly showing other elements that underlie the exposed elements.

FIG. 4 illustrates the same structures shown in FIG. 3 but with the panel 34, the water dispensing selector 35, the cubed ice dispensing selector 36 and the crushed ice dispensing selector 37 not shown in order to more clearly disclose the location of and structural and functional relationships among certain components of the dispensing unit 30 that are located behind the panel 34. The interrelationships among these additional components of the dispensing unit and the functions they perform are described in detail below. However, it is noted here that the dispensing unit 30 can include a lighting system that includes at least one lighting element 41 that functions to illuminate the recess 22 whenever water or ice is being dispensed at the dispensing station 32.

Figure 5:
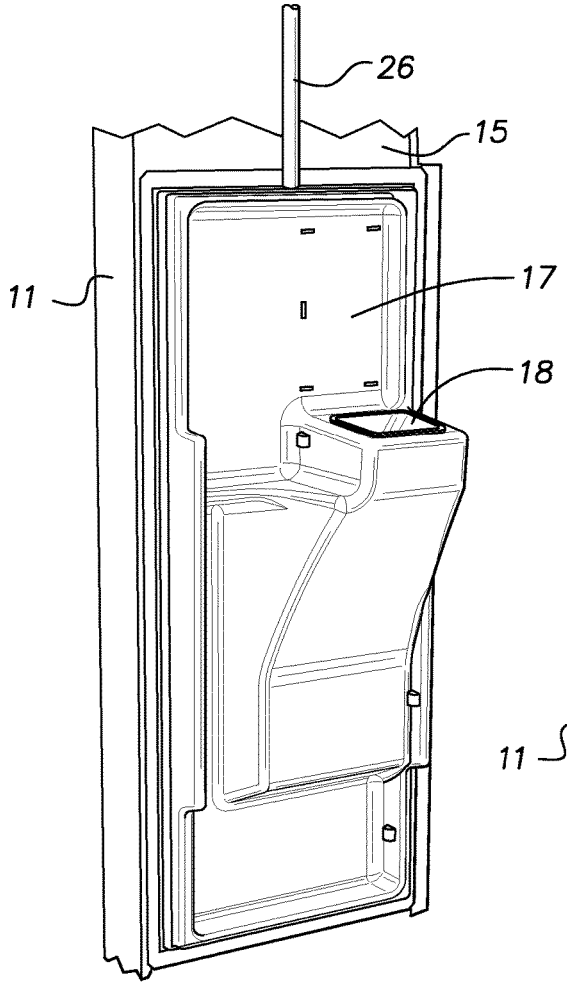
FIG. 5 is a perspective rear view of the portion of the refrigeration appliance shown in FIG. 3.
Figure 6:
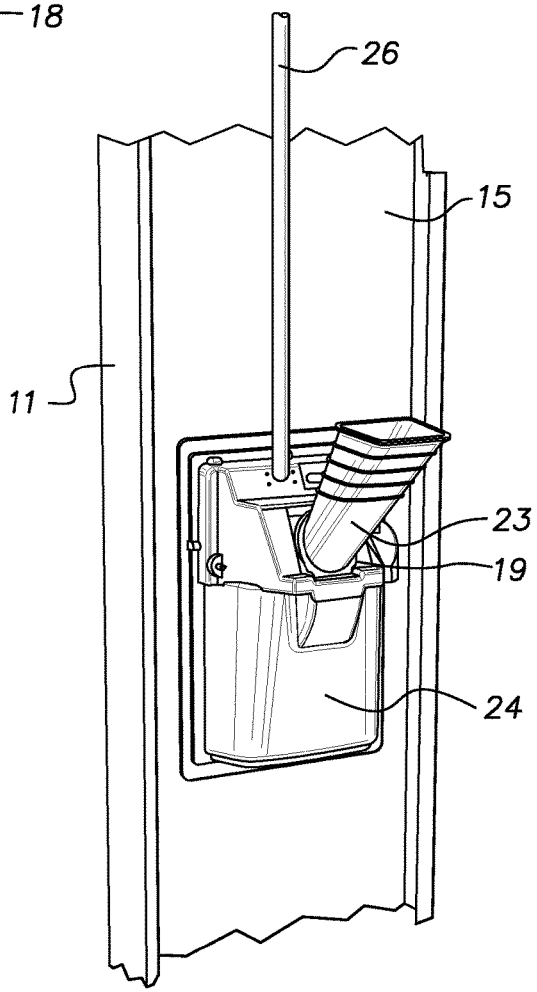
FIG. 6 is a perspective view of the portion of the refrigeration appliance shown in FIG. 5 with certain exposed portions of FIG. 5 not shown for the purpose of more clearly showing structures that underlie the exposed portions.
Figure 7:
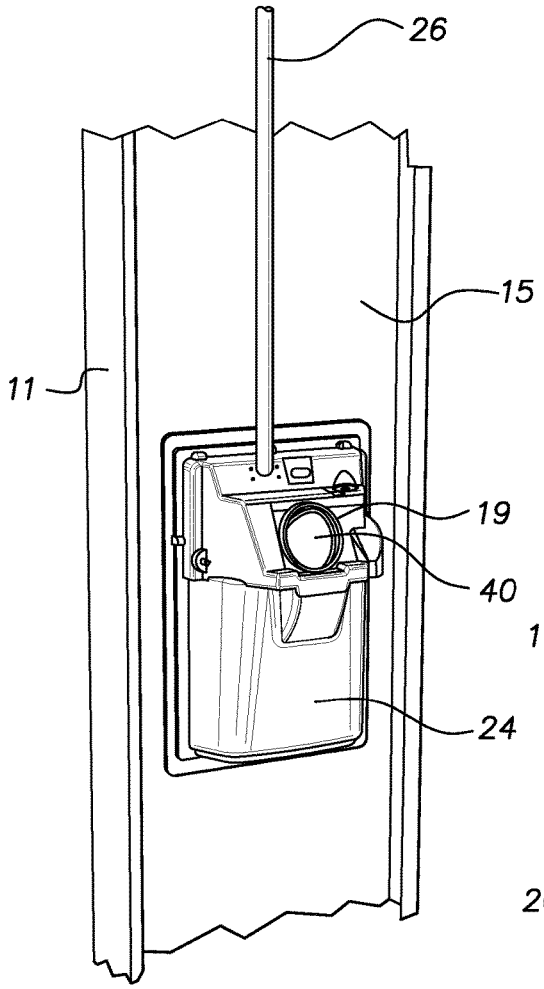
FIG. 7 is a perspective view of the portion of the refrigeration appliance shown in FIG. 6 with certain exposed portions of FIG. 6 not shown for the purpose of more clearly showing structures that underlie the exposed portions.
Figure 8:
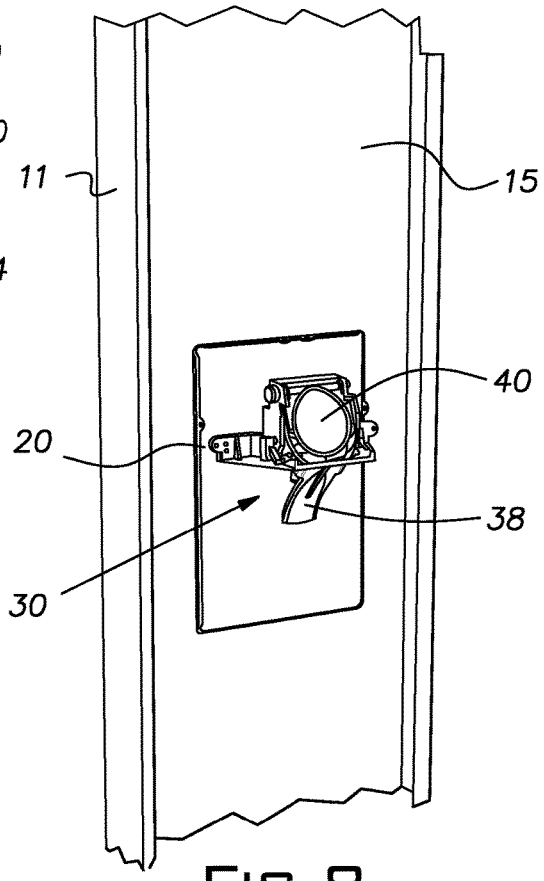
FIG. 8 is a perspective view of the portion of the refrigeration appliance shown in FIG. 7 with certain exposed portions of FIG. 7 not shown for the purpose of more clearly showing structures that underlie the exposed portions.

Reference is now had to FIGS. 5 through 8 for a description of the structures that house and support the dispensing unit 30 at the first fresh food compartment door 11 as well as structures that are included in the water delivery system and the ice delivery system. In FIG. 5, the interior facing 15 of the first fresh food compartment door 11 at the location of the dispensing unit 30 is shown as closed off from the interior of the fresh food compartment 14 by the housing 17 that can be attached to the interior facing 15 by suitable fasteners. The housing opening 18 in the housing 17, as noted above, is aligned with a discharge point for ice at the ice maker 16 when the first fresh food compartment door 11 is closed. In this connection, as best seen in FIG. 6 in which the housing 17 is not shown in order to disclose certain of the components that lie within the housing 17, an ice delivery chute 23 is arranged to extend between the housing opening 18 in the housing 17 and the dispensing unit 30 through a chute opening 19 in an enclosure 24. The enclosure 24, which can be attached to the interior facing 15 of the first fresh food compartment door 11, surrounds the access opening 20 in the front panel 21 of the first fresh food compartment door 11, substantially defines the parameters of the dispensing station 32 and establishes the recess 22 into which a receptacle can be inserted for the dispensing of water and ice upon engagement of the receptacle with the paddle 38. As best seen in FIG. 7, wherein the ice delivery chute 23 is not shown, and FIG. 8, wherein the enclosure 24 also is not shown and which indicates the location of the dispensing unit 30 at the access opening 20 in the front panel 21 of the first fresh food compartment door 11, a bottom of the ice delivery chute 23 that extends through the chute opening 19 seats against the seating surface 40 of an ice door, described below, of the dispensing unit 30 so as to prevent unwanted ice that enters the ice delivery chute 23 from being dispensed at the dispensing station 32.

In the examples of the invention illustrated in the figures, the ice delivery chute 23 is included in the ice delivery system of the dispensing system that is operably associated with the refrigeration appliance 10 and the dispensing station 32, including the dispensing unit 30, and is configured to deliver ice from the refrigeration appliance 10 to the dispensing station 32 controlled by the operation of the dispensing unit. In this connection, as is familiar to those having ordinary skill in the art, the ice maker 16 can include a cubed ice storage bin, not shown, that includes an auger that is driven by an electric motor and advances the stored cubed ice in the bin to the discharge point for the icemaker whenever ice is to be delivered to the dispensing station 32. And as also is familiar to those skilled in the art, in the case crushed ice is called for, the cubed ice as it advances to the discharge point for the ice maker can be crushed in an ice crusher not shown. In either case, the cubed ice or crushed ice as it reaches the discharge point for the ice maker 16 will be discharged through the housing opening 18 in the housing 17 into the ice delivery chute 23 and be delivered to and dispensed at the dispensing station 32 whenever the ice door located at the chute opening 19 is open.

The dispensing of water can be accomplished by a water delivery system that can be included in the dispensing system, be operably associated with the refrigeration appliance 10 and the dispensing station 32 and be configured to deliver water from the refrigeration appliance 10 to the dispensing station 32 as controlled by the operation of the dispensing unit 30. The system can include, for example, a conduit 26, a first end of which, not shown, is connected to a source of water through a solenoid valve at the refrigeration appliance 10, for example, and a second end of which is connected to the nozzle 28 which is mounted at the dispensing unit 30 as can be seen in FIGS. 3 and 4. As shown in FIGS. 5 through 7, the conduit 26 can be directed from the source of water through the housing 17 and the enclosure 24 to the nozzle 28 included in the dispensing unit 30.

Figure 9:
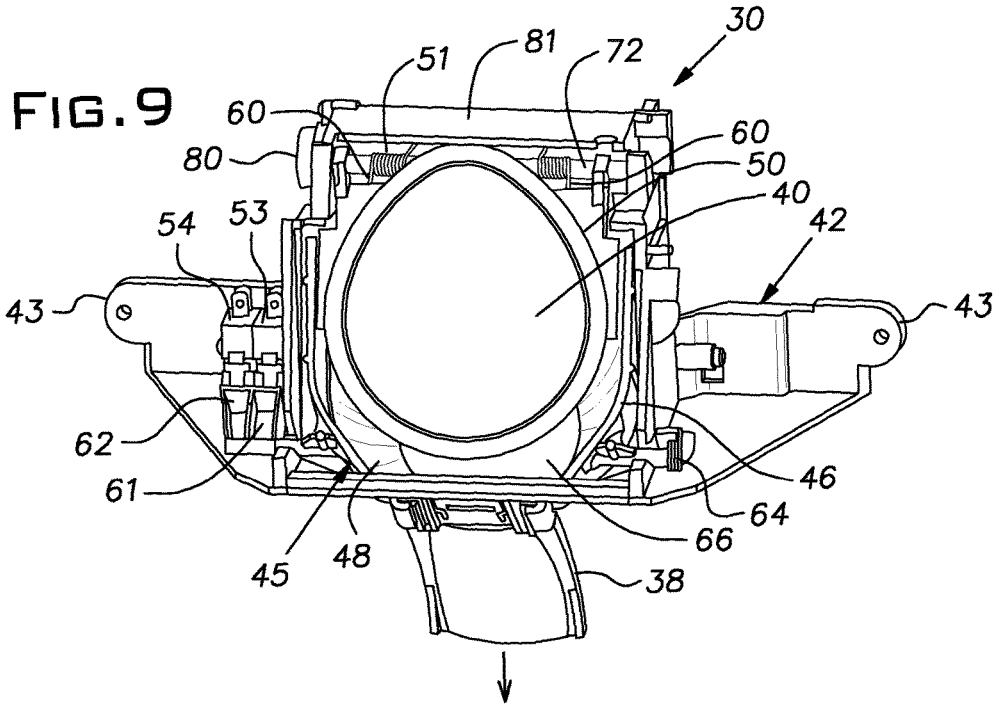
FIG. 9 is a perspective view of a dispensing unit according to a first aspect of the invention, wherein the unit is illustrated in a condition that supports neither the dispensing of water nor the dispensing of ice.
Figure 10:
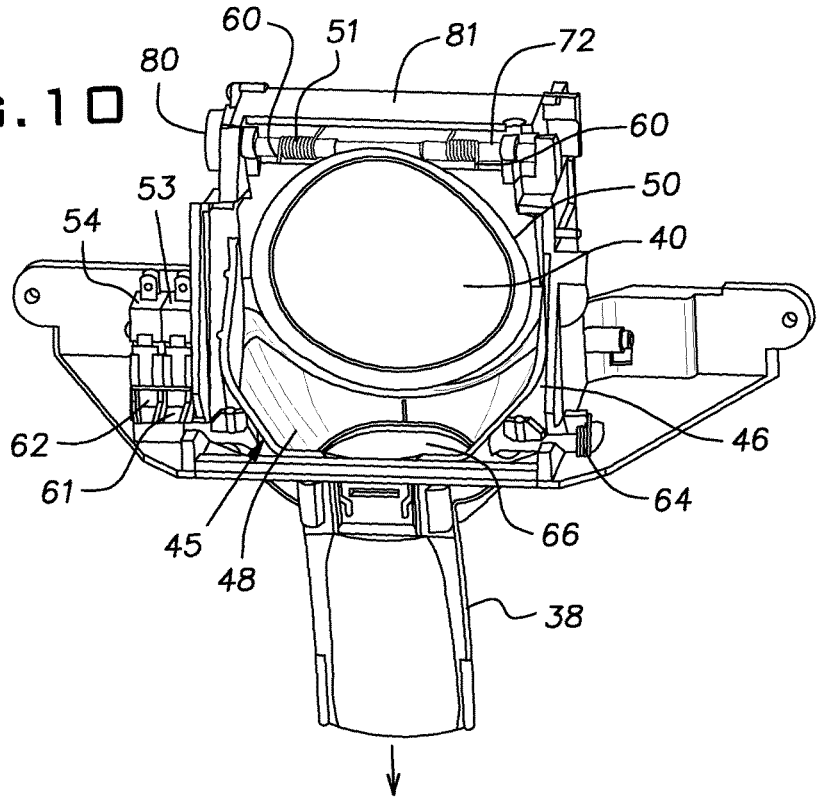
FIG. 10 is a perspective view of the dispensing unit of FIG. 9, wherein the unit is illustrated in condition that supports the dispensing of ice.

Turning now to a detailed description of the dispensing unit 30 according to an example of the present invention, reference is first had to FIGS. 9 and 10. In FIGS. 9 and 10, the dispensing unit 30 is shown to be operatively associated with a refrigeration appliance such as the refrigeration appliance 10 for selectively dispensing water and ice at a dispensing station such as the dispensing station 32.

In FIG. 9, an assembled example of the dispensing unit 30 is illustrated. The components of the assembled dispensing unit include a bracket, indicated generally at 42 that includes projection elements 43, 43 that are located at the front and on opposite sides of the bracket 42 and by means of which the bracket is secured to the enclosure 24 by suitable fasteners so as to be positioned as shown in FIG. 4. As best seen in FIG. 4, the projection elements 43 of the bracket 42 when attached to the enclosure 24 lie substantially at the front of the recess 22 of the dispensing station 32, and comprise the front of the bracket, and the remainder of the bracket and the other components of the dispensing unit 30 are located deeper within or toward the rear of the recess 22. The dispensing unit 30, additionally, includes an actuator, indicated generally at 45, that is rotatably mounted in the bracket 42. The paddle 38 comprises a depending portion of the actuator 45 and extends downwardly in the recess 22 of the dispensing station 32. The paddle 38 is integral with an ice chute 46 that also comprises a component of the actuator 45. The movement of the paddle 38 from the front towards the rear of the recess 22 causes the actuator 45 to rotate in the bracket 42.

Whenever neither water nor ice is to be dispensed at the dispensing station, the actuator 45, including the paddle 38, occupies a first or neutral position, sometimes referred to herein as the "non-dispensing position." In this first position, the actuator 45 and the paddle 38 neither support the delivery of water by the water delivery system nor the delivery of ice by the ice delivery system from the refrigeration appliance 10 to the dispensing station 32 nor the dispensing of water or ice at the dispensing station. However, the actuator 45 can be rotated in the bracket 42 by the advancement of the paddle 38 in the direction of the arrow of FIG. 9 towards the rear of the recess 22 whenever water or ice is to be dispensed. Thus, the actuator 45 and the paddle 38 are movable from the first or non-dispensing position to a second position, sometimes referred to herein as the "water-dispensing position," at which second position the actuator 45 and the paddle 38 support the delivery of water by the water delivery system from the refrigeration appliance 10 to the dispensing station 32 and the dispensing of water at the dispensing station. When the actuator 45 and the paddle 38 are in the second or water-dispensing position, they do not support the delivery of ice by the ice delivery system from the refrigeration appliance 10 to the dispensing station 32 nor the dispensing of ice at the dispensing station. However, the paddle 38 can be further advanced towards the rear of the recess 22 and the actuator 45 correspondingly further rotated in the bracket 42 from the first position through the second position to a third position, sometimes referred to herein as the "ice-dispensing position." In the third position, the actuator 45 and the paddle 38 support the delivery of ice by the ice delivery system from the refrigeration appliance 10 to the dispensing station 32 and the dispensing of ice at the dispensing station. Thus, when water is to be dispensed, the paddle 38 is advanced in the recess 22 from the first position to the water-dispensing position causing the actuator 45 to rotate in the bracket 42 to the water-dispensing position. And when ice is to be dispensed, the paddle 38 is advanced in the recess 22 to the ice-dispensing position causing the actuator 45 to rotate in the bracket 42 to the ice-dispensing position.

The actuator 45 also includes a passageway, indicated generally at 48 and defined by the ice chute 46, through which ice can be selectively delivered by the ice delivery system from the refrigeration appliance 10 through the ice delivery chute 23 to the dispensing station 32 and dispensed through the ice chute 46 of the actuator at the dispensing station 32 whenever an ice door 50 that includes the seating surface 40 assumes a position away from the bottom of the ice delivery chute 23, thereby opening the passageway 48 to the dispensing of ice. In FIG. 9, the paddle 38 and the actuator 45 are illustrated as being in the first or non-dispensing position and in FIG. 10, the paddle 38 and the actuator 45 are illustrated as being in the third or ice-dispensing position, with the ice door 50 assuming a position away from the bottom of the ice delivery chute 23 at the chute opening 19, thereby opening the passageway 48 for the dispensing of ice.

The advancement of the paddle 38 towards the rear of the recess 22 and the concomitant rotation of the actuator 45 at the bracket 42 can be accomplished by a user inserting a receptacle such as a drinking glass into the recess 22, engaging the paddle 38 by pushing the drinking glass against the paddle and advancing the paddle in the recess 22 from the first position to the second position for example. Similarly, the rotation of the actuator 45 from the first position through the second position to the third position supporting the dispensing of ice at the dispensing station 32 is carried out by the user inserting the drinking glass into the recess 22 and pushing the drinking glass against the paddle 38 so as to advance the paddle from the first position through the second position further towards the rear of the recess 22 to the third position.

In the embodiment shown in FIG. 9, the ice door 50 of the dispensing unit 30 is operatively associated with the actuator 45 and is configured, as shown in FIG. 9, to assume a position closing off the passageway 48 to the dispensing of ice when the actuator 45 is in the first position and when the actuator is in the second position. The ice door 50 also is configured to assume a position opening the passageway 48 to the dispensing of ice by a mechanical operation when the actuator 45 is in the third position as illustrated in FIG. 10. As described in greater detail below, the operative association of the ice door 50 with the actuator 45 is such that the placement of the actuator in the third position causes the ice door 50 to assume the position opening the passageway 48 to the dispensing of ice. The movement of the ice door 50 from a position closing off the passageway 48 to the dispensing of ice to a position opening the passageway 48 to the dispensing of ice occurs against the energy provided by an elongated coiled tension spring 51 as described below.

The example of the dispensing unit 30 illustrated in the figures also can include, as shown in FIGS. 9 and 10, a first actuating device 53, which can comprise a switch that is engageable by the actuator 45 when the actuator is in the second position. The first actuating device 53 is configured to function in a first operational state not supporting the dispensing of water at the dispensing station 32 when the actuator 45 is in the first or non-dispensing position and to function in a second operational state supporting the dispensing of water at the dispensing station 32 when the actuator 45 is in the second or water-dispensing position. The dispensing unit 30 also can include a second actuating device 54, which can comprise a second switch that is engageable by the actuator 45 when the actuator is in the third position. The second actuating device 54 is configured to function in a third operational state not supporting the dispensing of ice at the dispensing station 32 when the actuator 45 is in the first or non-dispensing position and when the actuator 45 is in the second or water-dispensing position and to function in a fourth operational state supporting the dispensing of ice at the dispensing station 32 when the actuator 45 is in the third or ice-dispensing position.

As indicated above, the placement of the actuator 45 in the second or water-dispensing position supports the delivery of water from the refrigeration appliance 10 to and the dispensing of the water at the dispensing station 32, and the placement of the actuator 45 in the third or ice-dispensing position supports the delivery of ice from the refrigeration appliance 10 to and the dispensing of the ice at the dispensing station 32. However, the actual delivery of water and ice to and the dispensing of water and ice at the dispensing station in the example of the figures, in addition to requiring that the actuator 45 be in the second position for the delivery and dispensing of water and in the third position for the delivery and dispensing of ice, requires that an appropriate one on the water dispensing selector 35, cubed ice dispensing selector 36 and crushed ice dispensing selector 37 be activated. The water dispensing selector 35 is provided for selecting water to be delivered from the refrigeration appliance 10 to the dispensing station 32 and dispensed at the dispensing station when the actuator 45 is in the water-dispensing position and the water dispensing selector has been activated. Thus, the water dispensing selector 35 is operably associated with the water delivery system and is selectively operable upon activation to place the water delivery system in a water-delivery mode. The placement of the water delivery system in the water-delivery mode by the water dispensing selector 35, together with the placement of the actuator 45 in the water-dispensing position, results in the delivery of water by the water delivery system from the refrigeration appliance 10 to the dispensing station 32 and the dispensing of the water at the dispensing station.

With respect to the delivery and dispensing of ice, one of the ice dispensing selectors, either the cubed ice dispensing selector 36 for cubed ice or the crushed ice dispensing selector 37 for crushed ice, is provided for selecting ice to be delivered from the refrigeration appliance 10 to the dispensing station 32 and dispensed at the dispensing station when the actuator 45 is in the ice-dispensing position and one of the ice dispensing selectors has been activated. Thus, the cubed ice dispensing selector 36 and the crushed ice dispensing selector 37 are operably associated with the ice delivery system and are selectively operable upon activation to place the ice delivery system in an ice-delivery mode. The placement of the ice delivery system in the ice-delivery mode by either the cubed ice dispensing selector 36 or the crushed ice dispensing selector 37, together with the placement of the actuator 45 in the ice-dispensing position, results in the delivery of ice by the ice delivery system from the refrigeration appliance 10 to the dispensing station 32 and the dispensing of ice at the dispensing station.

In order to provide for the selective dispensing of water and ice at the dispensing station 32 of the refrigeration appliance 10, a controller 90, referred to in FIG. 17, that is operably associated with the actuator 45, the water dispensing selector 35, the cubed ice dispensing selector 36 and the crushed ice dispensing selector 37 can be provided. The controller 90 also can be operably associated with the water delivery system and the ice delivery system. The controller 90, described in greater detail below, causes water to be delivered from the refrigeration appliance 10 to and dispensed at the dispensing station 32 in response to an input signal indicating the placement of the actuator 45 in the water-dispensing position and a concurrent input signal indicating the activation of the water dispensing selector 35. Correlatively, the controller 90 causes ice to be delivered from the refrigeration appliance 10 to and dispensed at the dispensing station 32 in response to an input signal indicating the placement of the actuator 45 in the ice-dispensing position and a concurrent input signal indicating activation of one of the cubed ice dispensing selector 36 and the crushed ice dispensing selector 37. The controller 90 also can cause both water and ice to be dispensed in the same receptacle. In that case the receptacle is first placed in the water-dispensing position and then advanced to the ice-dispensing position as describe in greater detail below.

With respect to the relationship of the controller 90 with the water and ice delivery systems, the controller can be configured to control the placement of the water delivery system in the water-delivery mode and the selective delivery of water by the water delivery system from the refrigeration appliance to the dispensing station as well as to control the dispensing of water at the dispensing station, in response to the placement of the actuator 45 in the water-dispensing position. And the controller 90 can be configured to control the placement of the ice delivery system in the ice-delivery mode and the selective delivery of ice by the ice delivery system from the refrigeration appliance to the dispensing station as well as to control the dispensing of ice at the dispensing station, in response to the placement of the actuator in the ice-dispensing position. In addition, the lighting elements 41, of which there is at least one, can be operably associated with the first actuating device 53 and the controller 90 so that the placement of the first actuating device in the second operational state by the placement of the actuator 45 in the water-dispensing position energizes the lighting elements 41.

In the example of the invention in which the first actuating device 53 and the second actuating device 54 are employed, the controller 90 is operably associated with the actuator 45 through the first actuating device and the second actuating device. Thereby, the controller 90 causes water to be delivered from the refrigeration appliance 10 to and dispensed at the dispensing station 32 in response to the placement of the first actuating device 53 in the second operational state and the activation of the water dispensing selector 35, and ice to be delivered from the refrigeration appliance 10 to and dispensed at the dispensing station 32 in response to the placement of the second actuating device 54 in the fourth operational state and the activation of an ice dispensing selector, either cubed ice dispensing selector 36 or crushed ice dispensing selector 37.

Referring now to FIGS. 11 and 12, a subassembly of elements of the dispensing unit 30 comprising the actuator 45, the bracket 42 and certain other components of the dispensing unit are shown for the purpose of describing in detail the structural and functional relationships among those elements. In FIG. 11, the ice door 50 is not shown for the purpose of more clearly presenting the other components and elements. In FIG. 12, the ice door 50 is included but the bracket 42 is omitted. It is noted that the arrangements of the components and elements as shown in FIGS. 11 and 12 are as they appear when the actuator 45 is in the first or non-dispensing position.

For the purpose of mounting the actuator 45 for rotational movement at the bracket 42, the actuator 45 includes a first arm 55 and a second arm 56 that are located and attached at opposite sides of the ice chute 46 of the actuator 45. The first arm 55 is rotatably supported in a first journal 58 and the second arm 56 is rotatably supported in a second journal 59, each of which journals form a part of the bracket 42. Fixed to and extending at right angles from the first arm 55 toward the front of the bracket 42 and the first actuating device 53 and the second actuating device 54 are a first switch arm 61 and a second switch arm 62. The first switch arm 61 is configured to engage the first actuating device 53 and the second switch arm 62 is configured to engage the second actuating device 54. As will be understood by those skilled in the art, the actuating devices comprise switches that are fixedly mounted to the front of the bracket 42, are activated when the actuator 45 reaches the first and second positions, respectively, and are deactivated when the actuator is returned to the first position.

As has been discussed, the first actuating device 53 is engageable by the actuator 45 through the instrumentality of the first switch arm 61. However, when the actuator 45 and the first switch arm 61 are in respective positions corresponding to the first or non-dispensing position as shown in FIG. 11, the first actuating device 53 will not be activated by the first switch arm 61. In that circumstance, the first actuating device 53 is configured to function in a first operational state that does not support the delivery of water by the water delivery system to the dispensing station 32 from the refrigeration appliance 10 nor the dispensing of water at the dispensing station 32. When the actuator 45 and the first switch arm 61 are in respective positions corresponding to the second or water-dispensing position, the first actuating device 53 will be activated by the first switch arm 61. In that circumstance, the first actuating device 53 is configured to function in a second operational state that supports the delivery of water by the water delivery system to the dispensing station 32 from the refrigeration appliance and the dispensing of water at the dispensing station.

When the actuator 45 and the second switch arm 62 are either in respective positions corresponding to the first or non-dispensing position as shown in FIG. 11 or are in respective positions corresponding to the second or water-dispensing position, the second actuating device 54, which is engageable by the actuator 45 through the second switch arm 62, will not be activated by the second switch arm 62. In each of those circumstances, the second actuating device 54 is configured to function in a third operational state that does not support the delivery of ice by the ice delivery system to the dispensing station 32 from the refrigeration appliance 10 nor the dispensing of ice at the dispensing station. When the actuator 45 and the second switch arm 62 are in respective positions corresponding to the third or ice-dispensing position, the second actuating device 54 will be activated by the second switch arm 62. In that circumstance, the second actuating device 54 is configured to function in a fourth operational state that supports the delivery of ice by the ice delivery system to the dispensing station 32 from the refrigeration appliance 10 and the dispensing of ice at the dispensing station.

The second operational state of the first actuating device 53 and the fourth operational state of the second actuating device 54 comprise operational states in which the actuating devices deliver input signals to the controller 90. The first operational state of the first actuating device 53 and the third operational state of the second actuating device 54 comprise operational states in which the actuating devices do not deliver input signals to the controller 90.

The rotation of the actuator 45 about an axis of rotation that extends through the first arm 55 and the second arm 56 of the actuator 45 is imparted to the actuator, as indicated above, by means of the paddle 38 that is integral with the ice chute 46 of the actuator 45 and forms a downwardly depending and forwardly projecting part of the actuator so as to extend into the recess 22 of the dispensing station 32. As the paddle 38 is advanced towards the rear of the recess 22, away from the front of the recess in the direction of the arrow that appears in FIG. 11, such as by pushing a receptacle against the paddle 38, causing the paddle to advance from the non-dispensing position toward the water-dispensing position, the actuator 45 by means of the first arm 55 and the second arm 56 is caused to rotate in the first journal 58 and the second journal 59, respectively, of the bracket 42. As a result, when the paddle 38 reaches the water-dispensing position, the first switch arm 61 will have rotated downwardly in the bracket 42 a sufficient distance to have activated the first actuating device 53 and placed the first actuating device in the second operational state supporting the dispensing of water at the dispensing station 32. Further advancement of the paddle 38 towards the rear of the recess 22 in the direction of the arrow of FIG. 11, and the concomitant further rotation of the actuator 45 in the bracket 42, causes the further rotational movement downwardly in the bracket 42 of the second switch arm 62 which results in the activation of the second actuating device 54 by the second switch arm 62 and the placement of the second actuating device in the fourth operational state supporting the dispensing of ice at the dispensing station 32.

It can be seen in the example of FIG. 11 that the first actuating device 53 and the second actuating device 54, which can be alike, are mounted on the bracket 42 so as to be positioned at the same height in relation to the axis of rotation of the actuator 45 through the first arm 55 and the second arm 56. However, the portion of the first switch arm 61 that contacts the first actuating device 53 for the purpose of activating the first actuating device is arranged with relation to the portion of the second switch arm 62 that contacts the second actuating device 54 for the purpose of activating the second actuating device so that the first switch arm 61 will engage the first actuating device 53 when the actuator 45 has been rotated by the paddle 38 to the water-dispensing position and the second switch arm 62 will engage the second actuating device when the actuator 45 has been rotated by the paddle 38 to the ice-dispensing position.

As noted, in the example of FIG. 11, the various components of the dispensing unit 30 are shown as they would be arranged when the actuator 45 is in the first or non-dispensing position; that is, the paddle 38 is in its forward-most position in the recess 22 and neither the first actuating device 53 nor the second actuating device 54 will have been activated by the first switch arm 61 and the second switch arm 62, respectively. Thus, in the context of FIG. 11, the first actuating device 53 will be in the first operational state and the second actuating device 54 will be in the third operational state.

The advancement of the paddle 38 from the non-dispensing position at the front of the recess 22 towards the rear of the recess takes place against the resistance of a coiled tension spring 64 that is attached to the second arm 56. A free end 65 of the coiled tension spring 64 extends away from the second arm 56 and is configured to engage an abutment at the bracket 42 when the second arm 56 rotates as the paddle 38 is advanced towards the back of the recess 22, causing the coiled tension spring to be wound on the second arm 56. And when the force applied to the paddle 38 for the purpose of advancing the paddle 38 rearwardly in the recess 22, such as would be applied when a receptacle is forced against the paddle 38, is released, the coiled tension spring 64 will unwind, causing the second arm 56 to rotate in a direction counter to the direction in which the second arm rotated upon advancement of the receptacle towards the rear of the recess 22. As a result, the actuator 45, including the paddle 38 will return to the non-dispensing position. As this occurs, the first switch arm 61 and the second switch arm 62, having activated the first actuating device 53 and the second actuating device 54, respectively, for the purpose of supporting the delivery of water and ice from the refrigeration appliance to the dispensing station, assuming that the paddle 38 has been advanced all the way to the ice-dispensing position, will return to the respective positions they assume when the paddle 38 is located in the non-dispensing position. During this return of the first switch arm 61 and the second switch arm 62, the switch arms will cause the first actuating device 53 and the second actuating device 54, respectively, to deactivate so as to place the first actuating device 53 in the first operational state and the second actuating device 54 in the third operational state.

As shown in FIG. 11, the interior of the ice chute 46 of the actuator 45 is provided with sloping surfaces that converge downwardly toward an ice dispensing opening 66. The sloping surfaces of the actuator define the passageway 48 through which ice can be delivered to the ice dispensing opening 66 and dispensed at the dispensing station 32 as is described in greater detail below. Extending upwardly from these laterally opposed sloping surfaces of the actuator 45 are upstanding lateral sides 68, 68 of the actuator. Each upstanding lateral side 68 includes at one end thereof an actuating member 70 in the nature of a cylindrical pin in the example of FIG. 11 that projects inwardly of the upstanding lateral side. The actuating members 70, 70 are aligned with one another through an axis that is parallel to the axis of rotation of the actuator 45 through the first arm 55 and the second arm 56.

Also mounted at the bracket 42 for rotation in the bracket are a mounting rod 72 and a gear rod 74. A first toothed wheel 75 is located at a first end of the gear rod 74 and a second toothed wheel 76 is located at a second end of the gear rod. The first end of the gear rod 74 is journaled to the bracket 42 for rotation at the bracket while the second end of gear rod 74 passes through an opening in the bracket 42 and is journaled for rotation at a friction damper 80 that is mounted at the bracket 42. The mounting rod 72, as shown in FIG. 12, is threaded through the elongated coiled tension spring 51 that includes a U-shaped central portion 52 that is located beneath the underside of a bracket overhang 81. Depending end portions 60, 60 of the elongated coiled tension spring 51 extend downwardly in the direction of the passageway 48 at the respective ends of the elongated coiled tension spring and engage the underside of the ice door 50 for the purpose of causing the ice door 50 to seat against the bottom of the ice delivery chute 23 as described below.

Figure 13:
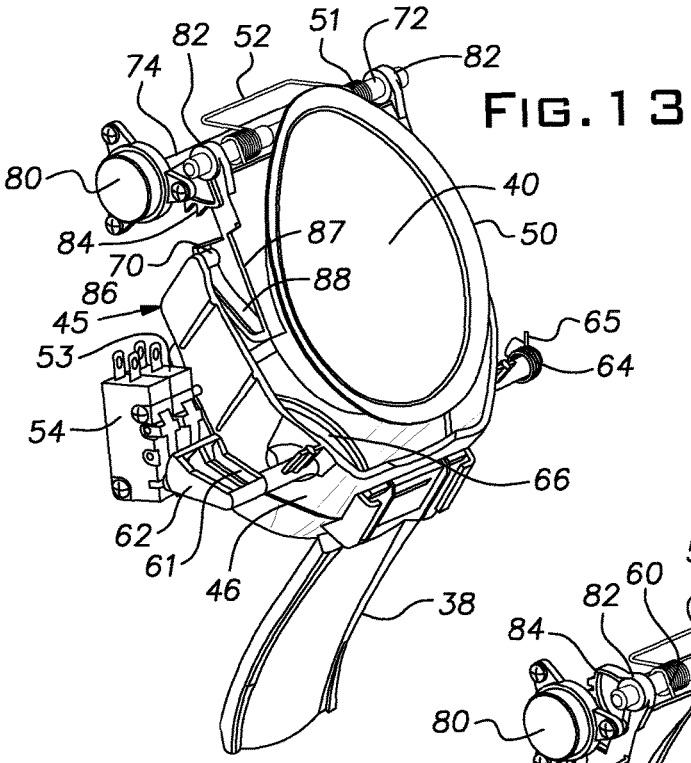
FIG. 13 is a perspective view of the second subassembly of the dispensing unit of FIG. 9, wherein the second subassembly is illustrated in a condition that supports the dispensing of water.
Figure 14:
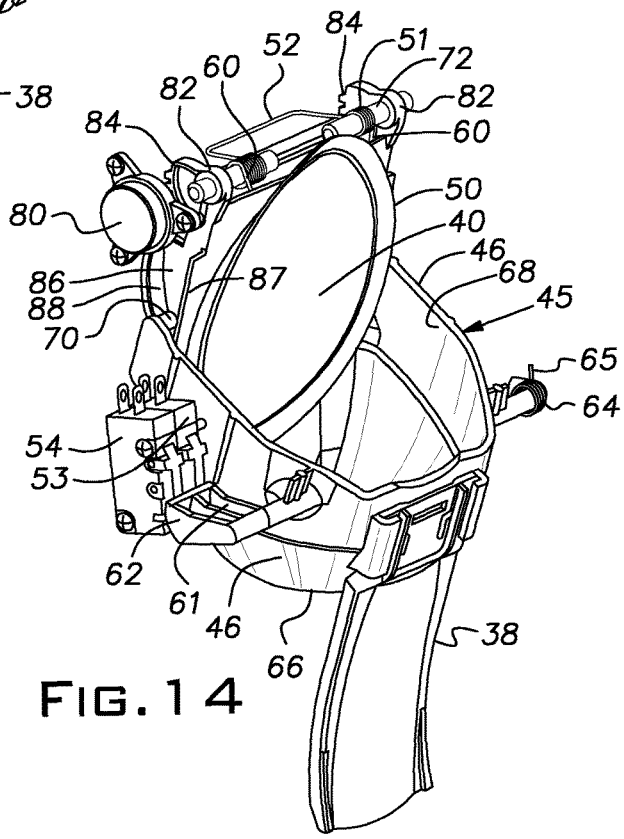
FIG. 14 is a perspective view of the second subassembly of the dispensing unit of FIG. 9, wherein the second subassembly is illustrated in a condition that supports the dispensing of ice.

Each of FIGS. 13 and 14 illustrates a subassembly of certain elements of the dispensing unit 30 comprising the actuator 45, the ice door 50 and several other components of the dispensing unit and are shown for the purpose of describing in detail the structural and functional relationships among those elements. In FIG. 13 the elements are shown in a water-dispensing position and in FIG. 14, the elements are shown in an ice-dispensing position.

Referring to FIGS. 12, 13 and 14, the ice door 50, in addition to including the seating surface 40, includes laterally opposed mounting brackets 82, 82 to which respective ends of the mounting rod 72 are attached, whereby the ice door 50 is fixedly supported on the mounting rod 72 so that the mounting rod 72 cannot rotate relative to the mounting brackets 82, 82. However, the mounting rod 72 is rotatable in the bracket 42 as has been described so that the ice door 50 can swing in the bracket 42 upon opening and closing the passageway 48 to the dispensing of ice. Integral with the laterally opposed mounting brackets 82, 82 are arcuate sections 84, 84 of toothed wheels, each of which meshes with a respective one of the first toothed wheel 75 and the second toothed wheel 76. As best seen in FIGS. 13 and 14, slots 86, 86 are provided at opposite sides of the ice door 50, and each of the actuating members 70, 70 is received in a respective one of the slots. Each of the slots 86, 86 includes a slot first side 87 and a slot second side 88 that comprises a curved or arcuate surface in the nature of a camming surface. The elements are arranged structurally so that each of the actuating members 70, 70 is located at a respective slot first side when the paddle 38 is in the non-dispensing position and the actuator 45 is in the corresponding position shown in FIG. 12. However, when the paddle 38 is advanced rearwardly in the recess 22, causing the actuator 45 to rotate in the bracket 42 from the non-dispensing position to the water-dispensing position, each of the actuating members 70, 70 also will rotate from a respective slot first side 87 to a position adjacent to or just engaging a respective slot second side 88 as shown in FIG. 13. And when the paddle 38 is further advanced to the ice-dispensing position, causing the actuator 45 to rotate further in the bracket 42, the actuating members 70, 70, by engaging respective slot second sides 88, 88 and moving downwardly along the curved surfaces of the slot second sides as the actuator 45 is moved to the ice-dispensing position, will cause the ice door 50 to swing inwardly of the actuator 45 away from the bottom of the ice delivery chute 23 against which it is seated so as to assume a position opening the passageway 48 to the dispensing of ice as shown in FIG. 14. As the ice door 50 swings to the open position, the arcuate sections of the toothed wheels 84, 84 will rotate and by meshing with a respective one of the first toothed wheel 75 and the second toothed wheel 76 will cause those toothed wheels and the gear rod 74 to rotate.

Based on the foregoing description, it will be understood to one skilled in the art that in one embodiment, the ice door 50 includes at least one slot 86 including a slot first side 87 and a slot second side 88; and the actuator 45 includes a respective actuating member 70 located within the at least one slot at the first side of the at least one slot when the actuator is in the first position, at the second side of the at least one slot when the actuator is in the second position and in engagement with the second side of the at least one slot as the actuator moves from the second position to the third position, thereby causing the ice door 50 to open the passageway to the dispensing of ice. And as described, the second side of the at least one slot can comprise a curved surface. Thus, when the actuator 45 rotates from a position at the first side of the slot, as shown in FIG. 12, to a position at the second side of the slot, as shown in FIG. 13, such as when the actuator 45 moves from the non-dispensing position to the water dispensing position, the actuator 45 is configured to avoid any contact with the ice door 50 that would cause the ice door to open the passageway 48 to the dispensing of ice as the actuator is moved from the first position to the second position. However, when the actuator is rotated from the water-dispensing position to the ice-dispensing position, as shown in FIG. 14, the actuator is configured to contact the ice door 50 as the actuator is moved from the second position to the third position, thereby causing the ice door to open the passageway 48 to the dispensing of ice.

The inward swinging of the ice door 50 in relation to the actuator 45, thereby opening the passageway 48 to the dispensing of ice, occurs against the stored energy of the elongated coiled tension spring 51 that is fixed to the mounting rod 72. Thus, the ice door 50 will begin to swing inwardly of the ice chute 46 of the actuator 45, as a result of the downward movement of the actuating members 70, 70 in the slots 86, 86 against respective curved surfaces at the slot second sides 88, 88. At the same time, and the mounting rod 72, to which the elongated coiled tension spring 51 is attached, will rotate in the bracket 42 and the U-shaped central portion 52 of the elongated coiled tension spring 51 will engage the underside of the bracket overhang 81, thereby resisting the inward movement of the ice door 50 in the ice chute 46. The continued rotation of the actuator 45, influenced by the rearward advancement of the paddle 38 in the recess 22, will overcome the resistance of the elongated coiled tension spring 51 and the ice door 50 will finally swing to the position shown in FIG. 14 when the paddle 38 reaches the ice-dispensing position. During this operation, the elongated coiled tension spring 51 will be wound around the mounting rod 72.

At such time as the pressure against the paddle 38 is released, such as would be the case when a receptacle forced against the paddle is removed, so that the elongated coiled tension spring 51 is allowed to unwind and the force on the elongated coiled tension spring is also released, the depending end portions 60, 60 of the elongated coiled tension spring 51, which lie beneath the ice door 50, will push the ice door to a position once again at which the seating surface 40 of the ice door is seated against the bottom of the ice delivery chute 23 at the chute opening 19, thereby closing off the passageway 48 to the dispensing of ice. As the ice door 50 swings to the closed position, the arcuate sections of the toothed wheels 84, 84 will mesh and rotate with a respective one of the first toothed wheel 75 and the second toothed wheel 76. The force applied by the depending end portions 60, 60 of the elongated coiled tension spring 51 will be resisted by the rotation of the one end of the gear rod 74 that is operatively associated with the friction damper 80 so that the ice door rather than slamming back to a position against the bottom of the ice delivery chute 23 will return to that position in a measured manner.

From the foregoing descriptions and disclosures, it will be understood by those having ordinary skill in the art that the present invention in one of its aspects provides for a dispensing unit 30 that includes an actuator 45 mounted at the dispensing station 32 for selective movement from a first non-dispensing position to a second water-dispensing position, the second position supporting the delivery of water by the water delivery system from the refrigeration appliance 10 to the dispensing station 32. The actuator 45 also is mounted for selective movement from the first position through the second position to a third ice-dispensing position, the third position supporting the delivery of ice by the ice delivery system from the refrigeration appliance 10 to the dispensing station 32. A first actuating device 53 is engageable by the actuator 45 for activation by the placement of the actuator in the second position and is operably associated with the water delivery system for placing the water delivery system in a mode to support the delivery of water by the water delivery system from the refrigeration appliance 10 to the dispensing station 32 upon activation of the first actuating device 53. A second actuating device 54 is engageable by the actuator 45 for activation by the placement of the actuator in the third position and is operably associated with the ice delivery system for placing the ice delivery system in a mode to support the delivery of ice by the ice delivery system from the refrigeration appliance 10 to the dispensing station 32 upon activation of the second actuating device 54.

In the embodiment described above, the seating surface 40 of the ice door 50 is shown to be ellipsoidal in outline with an elongated narrower portion of the seating surface being located adjacent the bracket overhang 81 above a broader portion of the seating surface. At the same time, the perimeter of the opening at the bottom of the ice delivery chute 23 against which the seating surface 40 of the ice door 50 seats can be circular. Because of the ellipsoidal outline of the seating surface 40, in the event the seating surface 40 is misaligned with the opening at the bottom of the ice delivery chute 23, the elongated nature of the seating surface 40 prevents an edge of the seating surface from entering that opening. Otherwise the entry of an edge of the seating surface into the opening at the bottom of the ice delivery chute 23 could prevent the ice door 50 from completely seating against the bottom of the ice delivery chute 23, thereby potentially providing an opening through which ice particles can fall into the dispensing station 32.

As noted above, the functioning of the dispensing unit 30 at the dispensing station 32 and the dispensing system according to the various aspects, embodiments and examples that have been described can be facilitated by the application of a controller that can comprise, for example, a microprocessor. As shown in the example of FIG. 17, such a controller 90 can function in response to input signals from components of the dispensing unit 30, including the first actuating device 53, the second actuating device 54, the water dispensing selector 35, the cubed ice dispensing selector 36 and the crushed ice dispensing selector 37. The controller 90 can be arranged so that, in response to input signals from these several components, the controller will issue output signals to selectively cause one or more of the lighting elements 41 of the lighting system to be energized, to cause the water delivery system to deliver water from the refrigeration appliance 10 to and the water to be dispensed at the dispensing station 32 and to cause the ice delivery system to deliver either cubed or crushed ice from the refrigeration appliance 10 to and the ice to be dispensed at the dispensing station 32. Thus, for example, in the event the controller 90 receives an input signal from the first actuating device 53, such as would occur for example, when the paddle 38 is advanced in the recess 22 by the user to the water-dispensing position, thereby causing the first switch arm 61 to activate the first actuating device 53, the controller can issue an output signal to the one or more lighting elements 41 causing the one or more lighting elements to be energized. And, in the event that the water dispensing selector 35 also has been activated by the user, the controller 90 will cause water to be delivered to and dispensed at the dispensing station 32 by opening a solenoid valve that controls the delivery of water from a source of water to the nozzle 28 at the end of conduit 26 at the dispensing station 32.

On the other hand, for example, if the user, rather than having activated the water dispensing selector 35, has activated either the cubed ice dispensing selector 36 or the crushed ice dispensing selector 37, upon the paddle 38 being advanced to the water-dispensing position, the controller 90 will cause the one or more lighting elements 41 to be energized but the controller will not cause water to be delivered to and dispensed at the dispensing station 32. However, further advancement of the paddle 38 in the recess 22 to the ice-dispensing position will cause the second switch arm 62 to activate the second actuating device 54, resulting in an input signal to the controller 90 which in response to that input signal will cause the ice delivery system to deliver either cubed or crushed ice from the ice maker 16 of the refrigeration appliance 10 to the dispensing station 32, depending on whether the user has activated the cubed ice dispensing selector 36 or the crushed ice dispensing selector 37. And the advancement of the ice in the ice storage bin associated with the ice maker 16 to the discharge point of the ice maker for delivery to the dispensing unit 30 can be accomplished by the controller 90 activating the electric motor that drives the auger that advances the ice in the ice storage bin. In the case in which the crushed ice dispensing selector 37 has been activated, the auger can first advance the ice in the ice storage bin to an ice crusher from which the crushed ice is advanced to the discharge point for delivery to the dispensing unit 30.

Thus, based on the foregoing description, it will be understood by one skilled in the art that the controller 90 can be operably associated with the actuator 45, the first actuating device 53, the second actuating device 54, the water delivery system, the ice delivery system, the water dispensing selector 35, the cubed ice dispensing selector 36 and the crushed ice dispensing selector 37. The controller can be configured to control the delivery of water by the water delivery system from the source of water at the refrigeration appliance 10 to the dispensing station 32 and the dispensing of water at the dispensing station 32, in response to the activation of the water dispensing selector 35 and the placement of the actuator 45 in the second or water-dispensing position. The controller also can be configured to control the delivery of ice by the ice delivery system from the ice maker 16 at the refrigeration appliance 10 to the dispensing station 32 and the dispensing of ice at the dispensing station 32, in response to the activation of either the cubed ice dispensing selector 36 or the crushed ice dispensing selector 37 and the placement of the actuator 45 in the third or ice-dispensing position.

In addition to the dispensing circumstances described in the preceding paragraph, if the user has activated both the water dispensing selector 35 and one of the cubed ice dispensing selector 36 or the crushed ice dispensing selector 37, upon the paddle 38 being advanced in the recess 22 to the water-dispensing position, the controller 90 will cause one or more lighting elements 41 to be energized and water dispensed at the dispensing station 32. Further advancement of the paddle 38 to the ice-dispensing position in the recess 22 will result in the controller 90 causing ice to be dispensed into the receptacle that has already received water. In all these instances, the release of the paddle 38 by the user will allow the paddle to return to the non-dispensing position and, in doing so, the first actuating device 53 and the second actuating device 54 will be deactivated by the first switch arm 61 and the second switch arm 62, respectively, as those switch arms return to the positions they normally assume when the paddle 38 is in the non-dispensing position.

FIGS. 15 and 16 illustrate another example of an ice door construction. In that alternative example, a two-piece ice door 100 includes a flapper 102 and a flapper supporting member 106. The flapper includes a seating surface 104 that is configured to seat against the bottom of the ice delivery chute 23 through which the ice passes to the passageway 48 of the actuator 45. The flapper supporting member 106 supports the flapper 102 by being joined to the flapper by a universal adjusting member, indicated generally at 108, such as a ball and socket joint for example, whereby the attitude of the flapper 102 can be adjusted as the ice door, when it closes, engages the bottom of the ice delivery chute 23 so that the seating surface 104 of the flapper seats against the bottom of the chute in a manner essentially entirely closing off the passage of ice through the opening at the bottom of the ice delivery chute 23 to the passageway 48.

The flapper supporting member 106 includes two interior legs 109, 109, each of which includes an extremity 110 that extends down over a collar 112 of the flapper 102 and two exterior legs 114, 114. Each of the two exterior legs 114, 114 includes an exterior leg intermediate section 115 that extends down over the collar 112 of the flapper 102 and is joined to a slotting bracket, indicated generally at 116. Each slotting bracket defines the slot 86 that includes the slot first side 87 and the slot second side 88 that has a curved surface. Each slot receives a respective actuating member 70 of the actuator 45. The two interior legs 109, 109 at their ends that are opposite their extremities 110, 110 and the two exterior legs 114, 114 at their ends that are opposite the slotting brackets 116, 116 are attached to an annulus 118 that comprises the socket of the ball and socket joint. A ball 119 that is attached to the flapper is retained within the annulus 118.

Figure 28:
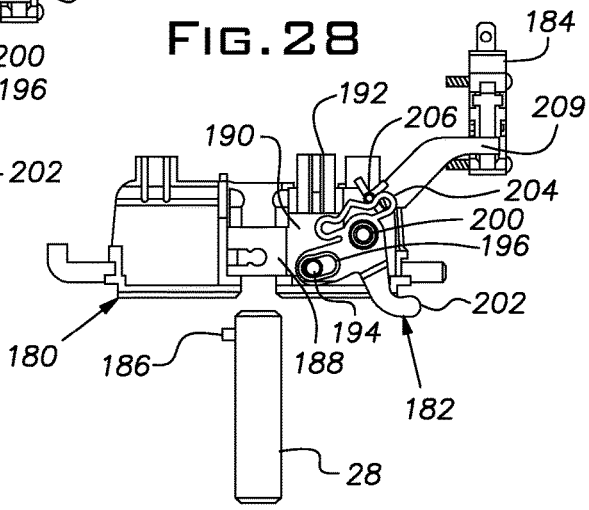

Integral with and located at the top of each slotting brackets is a respective one of the arcuate toothed wheels 84, 84 that engages and drives a respective one of the first toothed wheel 75 and the second toothed wheel 76 of the gear rod 74, not shown in FIGS. 28 and 29 as the two-piece ice door 100 opens. The two-piece ice door 100 is mounted to the mounting rod 72, each end of which is fixed to a respective one of the first toothed wheel 75 and the second toothed wheel 76.

Figure 18:
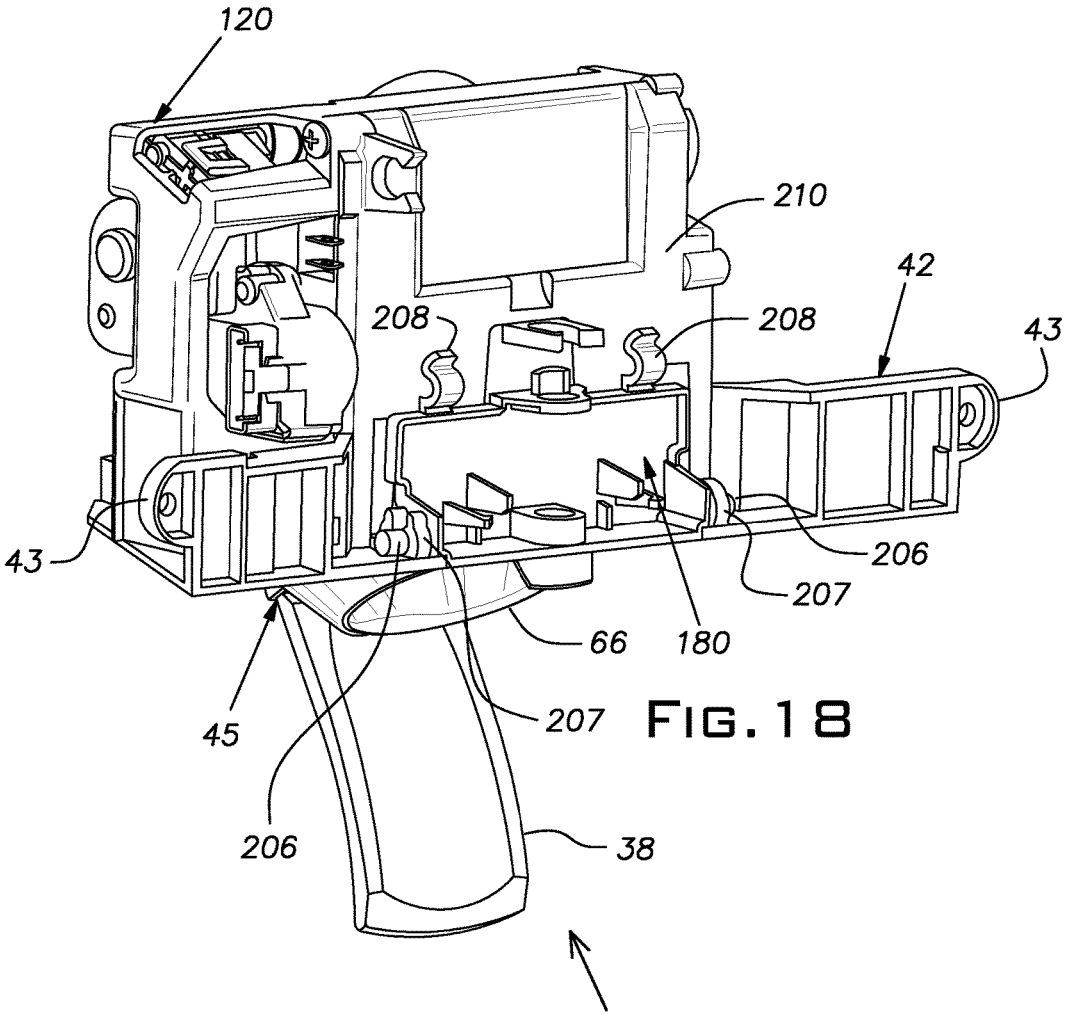
FIG. 18 is a general perspective view of a dispensing unit according to a second aspect of the invention.

According to a further embodiment of the dispensing unit 30, as generally illustrated illustrated in FIG. 18 and illustrated in detail in FIGS. 18 through 23, the actuator 45 and an ice door, such as a modified two-piece ice door 150, can operate independently of one another. In that case, the modified two-piece ice door 150 can be opened and closed, not by the functioning of the actuator 45, but by an electromechanical operation. In this further embodiment, the actuator 45 and the modified two-piece ice door 150 are mounted to the bracket 42, which as described above is secured to the enclosure 24 by means of projection elements 43. The actuator includes both the paddle 38 and the ice chute 46 that defines the passageway 48 as previously described. Also mounted to the bracket 42 is an ice door operator 120 that can comprise a DC electric motor for example, operatively associated with the modified two-piece ice door 150 and configured to cause the modified two-piece ice door to open the passageway 48 to the dispensing of ice as described in greater detail below.

Figure 19:
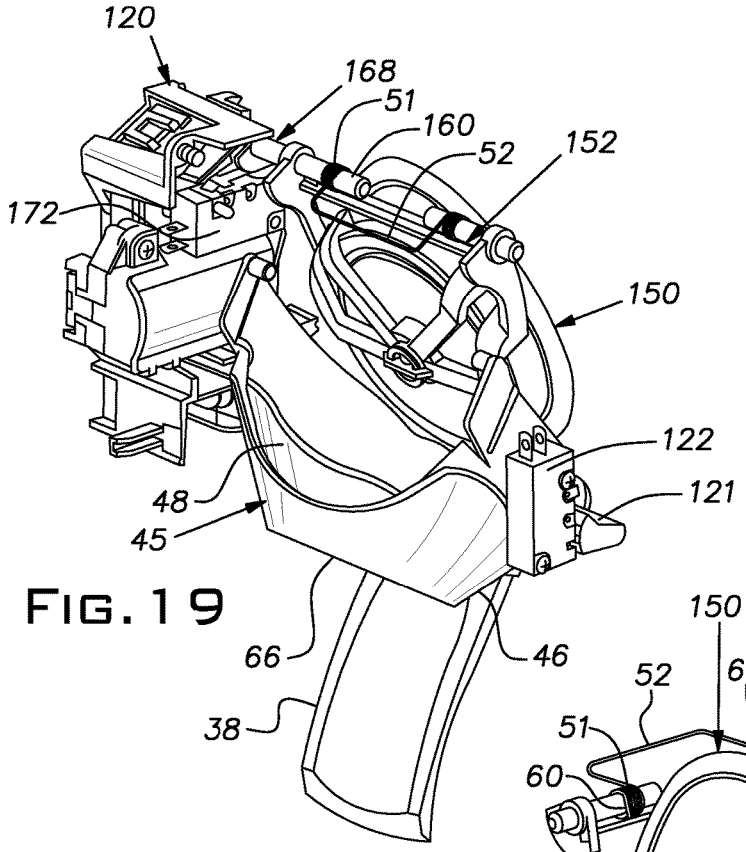
FIG. 19 is a perspective view from a first perspective of a first subassembly of the second aspect of the invention, wherein the subassembly is illustrated in a condition that supports neither the dispensing of water nor the dispensing of ice.
Figure 20:
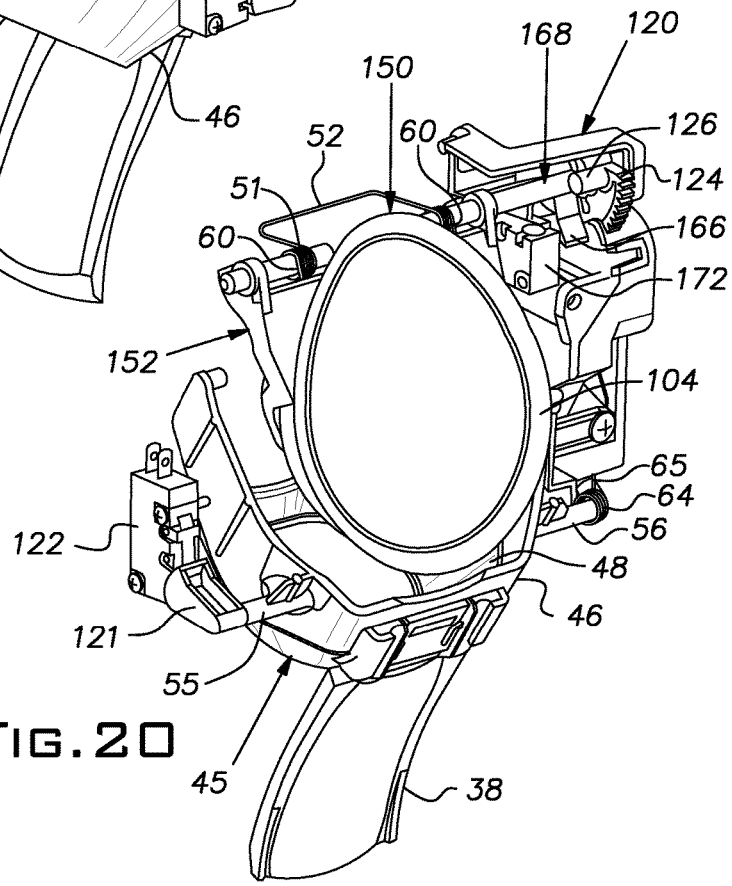
FIG. 20 is a perspective view from a second perspective of the first subassembly of the second aspect of the invention, wherein the subassembly is illustrated in a condition that supports neither the dispensing of water nor the dispensing of ice.

In the same manner as described above with reference to the mechanical embodiment illustrated in FIGS. 9 through 14, in the electromechanical embodiment of FIGS. 18 through 23, when neither water nor ice is to be dispensed, both the actuator 45 and the paddle 38 occupy the first position at which the actuator 45 and the paddle 38 neither support the delivery of water nor the delivery of ice from the refrigeration appliance 10. As previously noted with respect to the earlier-described embodiment, the actuator 45 can be rotated in the bracket 42 by the advancement of the paddle 38 towards the rear of the recess 22 whenever water or ice is to be dispensed. However, unlike with the mechanical embodiment, the actuator 45 and the paddle 38 are movable from the first position, at which first position the actuator 45 supports neither the dispensing of water nor the dispensing of ice, to a second position, at which second position the actuator 45 supports the dispensing selectively of both water and ice. In the case of the dispensing of water, the water can be selectively dispensed at the dispensing station 32 at the nozzle 28 when the actuator 45 is in the second position and water has been selected to be dispensed by the user activating the water dispensing selector 35. In the case of the dispensing of ice, the ice can be selectively dispensed at the dispensing station 32 through the passageway 48 of the actuator 45 when the actuator is in the second position and ice has been selected to be dispensed by the user activating either the cubed ice dispensing selector 36 or the crushed ice dispensing selector 37. In FIGS. 19 and 20, the actuator 45 is illustrated as being in the non-dispensing or first position with the modified two-piece ice door 150 assuming a position closing off the passageway 48 for the dispensing of ice.

In the embodiment shown in FIGS. 18 through 23, the two-piece modified ice door 150 of the dispensing unit 30 does not physically engage the actuator 45 for the purpose of selectively opening the passageway 48 to the dispensing of ice. Rather, as described in greater detail below, the ice door operator 120 is configured not to cause the modified two-piece ice door 150 to open the passageway to the dispensing of ice when the actuator 45 is in the first position and is configured to open the passageway to the dispensing of ice when the actuator is in the second position and ice has been selected to be dispensed by the user activating either the cubed ice dispensing selector 36 or the crushed ice dispensing selector 37. When the actuator 45 is in the second position and ice has not been selected to be dispensed, the ice door operator is configured not to cause the modified two-piece ice door 150 to open.

As shown in FIGS. 18 and 19, the dispensing unit includes a water and ice actuating device 122 that is engageable by a switch arm 121 for activation by the placement of the actuator in the second position which, as noted, comprises both a water and ice dispensing position as selectively determined. Thus, the water and ice actuating device 122 is operably associated with the water delivery system for placing the water delivery system in a mode to support the delivery of water by the water delivery system from the refrigeration appliance 10 to the dispensing station 32 upon activation of the water and ice actuating device 122 and the activation of the water dispensing selector 35; and the water and ice actuating device 122 is operably associated with the ice delivery system for placing the ice delivery system in a mode to support the delivery of ice by the ice delivery system from the refrigeration appliance 10 to the dispensing station 32 upon activation of the water and ice actuating device 122 and the activation of either the cubed ice dispensing selector 36 or the crushed ice dispensing selector 37.

The actuator 45 is mounted for rotational movement at the bracket 42, as described above, by means of the first arm 55 and the second arm 56 that are located and attached at opposite sides of the chute 46 of the actuator 45. Fixed to and extending at a right angle from the first arm 55 toward the front of the bracket 42 and the water and ice actuating device 122 is the switch arm 121. The switch arm 121 is configured to engage the water and ice actuating device 122. The water and ice actuating device 122 can comprise a switch that is configured to function in a first operational state not supporting the dispensing of water or ice at the dispensing station 32 when the actuator 45 is in the first position and to function in a second operational state supporting the selective dispensing of water and ice at the dispensing station 32 when the actuator 45 is in the second position.

For the purpose of opening the modified two-piece ice door 150 in order to dispense ice at the dispensing unit 30, the ice door operator 120 is provided. The ice door operator is configured to cause the modified two-piece ice door 150 to move away from the bottom of the ice delivery chute 23 at which the ice door closes off the delivery of ice to the passageway 48 and open the passageway to the dispensing of ice whenever the actuator 45 is in the second position, and ice has been selected at either the cubed ice dispensing selector 36 or the crushed ice dispensing selector 37 to be dispensed at the dispensing station 32. The ice door operator 120 also is configured to avoid causing the modified two-piece ice door 150 to open the passageway 48 to the dispensing of ice whenever the actuator is in the first position and whenever the actuator is in the second position and ice has not been selected to be dispensed at the dispensing station 32.

The ice door operator 120 can comprise a DC motor that includes an internal gearing arrangement, the details of which are not shown but are familiar to those skilled in the art, including a gear in the nature of a pinion that drives a curved rack 124. An actuating peg 126 is attached to the curved rack 124 and rotates with the rotation of the curved rack for the purpose of opening the modified two-piece ice door 150 as described below.

Figure 22:
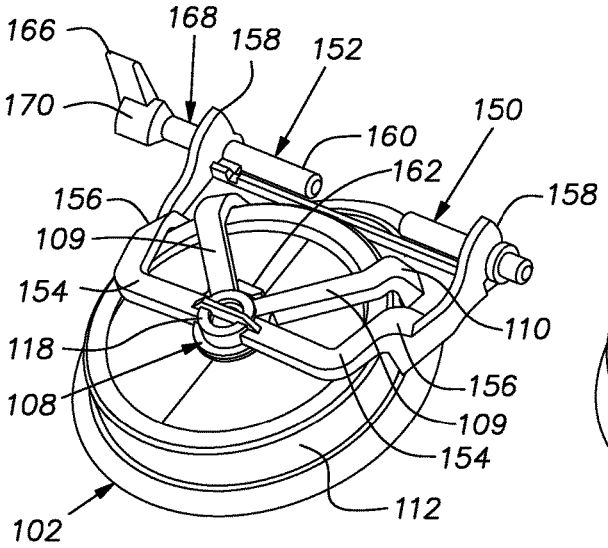
FIG. 22 is a perspective view of an embodiment of an ice door that can be employed with the second aspect of a dispensing unit according to the invention.
Figure 23:
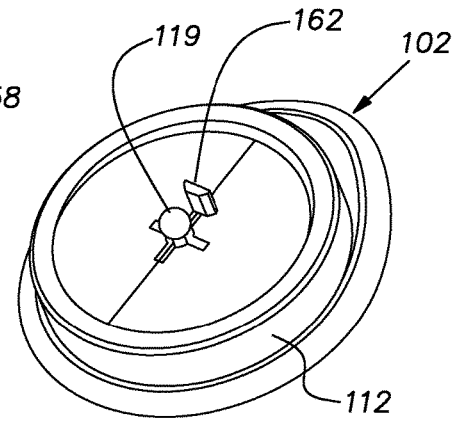
FIG. 23 is a perspective view of a component of the ice door of FIG. 22.

The modified two-piece ice door 150, as best seen in FIGS. 22 and 23, includes a flapper 102 and a modified flapper supporting member 152. The flapper 102 includes a seating surface 104 that is configured to seat against the bottom of the ice delivery chute 23 through which the ice passes to the passageway 48 of the actuator 45. The modified flapper supporting member 152 supports the flapper 102 by being joined to the flapper by a universal adjusting member, indicated generally at 108, such as a ball and socket joint for example, whereby the attitude of the flapper 102 can be adjusted as the modified two-piece ice door, when it closes, engages the bottom of the ice delivery chute 23 so that the seating surface 104 of the flapper seats against the bottom of the ice delivery chute in a manner essentially entirely closing off the passage of ice through the opening at the bottom of the ice delivery chute 23 to the passageway 48.

The modified flapper supporting member 152 includes two interior legs 109, 109, each of which includes an extremity 110 that extends down over a collar 112 of the flapper 102 and two modified exterior legs 154, 154. Each of the two modified exterior legs 154, 154 includes a modified exterior leg intermediate section 156 that extends down over the collar 112 of the flapper 102 and is integral with a respective exterior leg mounting bracket 158 that is fixedly attached to an ice door positioning member 160 that can comprise a discontinuous rod for example. The two interior legs 109, 109 at their ends that are opposite their extremities and the two modified exterior legs 154, 154 at their ends that are opposite the exterior leg mounting brackets 158, 158 are attached to an annulus 118 that comprises the socket of the universal adjusting member 108. A ball 119 that is attached to the flapper 102 is retained within the annulus 118. A restraining member 162 also is attached to the flapper and is located between the two interior legs 109, 109 where they attach to the annulus 118 for the purpose of retaining the modified flapper supporting member 152 substantially in place and not allowing the modified flapper supporting member 152 to rotate at the flapper 102 and impart a twisting force to the ice door positioning member 160.

Figure 26:
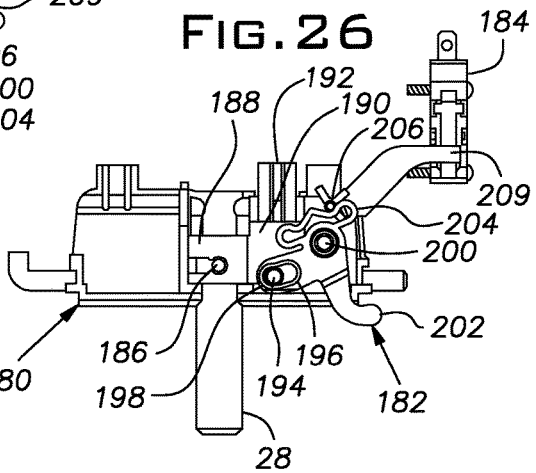
Figure 27:
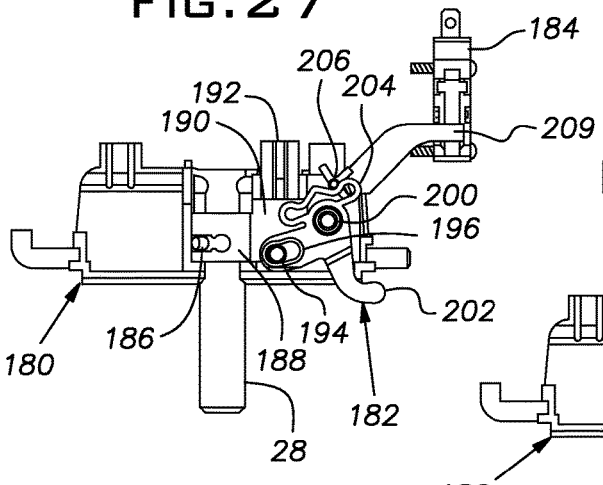

As can be seen in FIG. 26, the ice door positioning member 160 includes at actuating end portion 168 that is operatively associated with the ice door operator 120 and is configured to engage the actuating peg 126 so as to cause the modified flapper supporting member 152 to selectively move the modified two-piece ice door 150 between a closed position closing off the passageway 48 to the dispensing of ice and an open position opening the passageway 48 to the dispensing of ice. Specifically, when the paddle 38 has been moved to the second position, thereby actuating the water and ice actuating device 122, and one of the cubed ice dispensing selector 36 and crushed ice dispensing selector 37 has been activated, the ice door operator 120 will be activated so that the curved rack 124 and actuating peg 126 will rotate downwardly, driven by the pinion at the ice door operator 120. The actuating peg 126 will then engage the tab 166 at the actuating end portion 168 of the ice door positioning member 160 and the continued rotation of the curved rack 124 and the actuating peg 126 will cause the ice door positioning member 160 to rotate so as to swing the modified two-piece door open for the dispensing of ice through the passageway 48.

Figure 21:
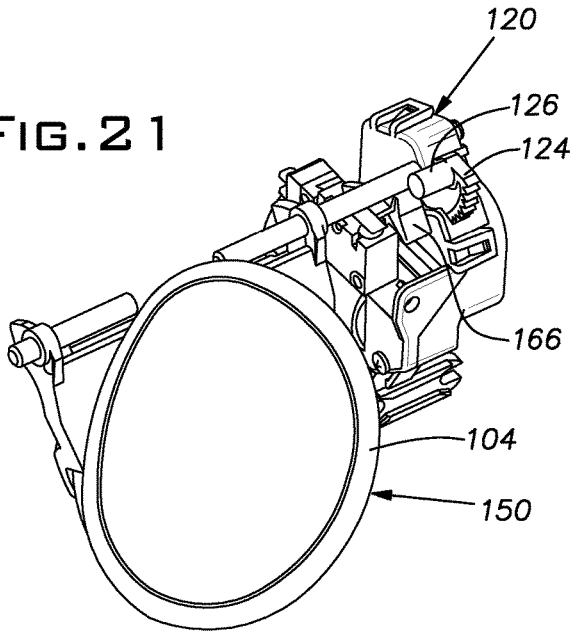
FIG. 21 is perspective view of a second subassembly of the second aspect of the invention, wherein the subassembly is illustrated in a condition that supports neither the dispensing of water nor the dispensing of ice.

Referring to FIGS. 19 and 20, the ice door positioning member 160 is contained within the elongated coiled tension spring 51, with the U-shaped section 52 of the elongated coiled tension spring engaging the underside of the bracket overhang 81, not shown in FIGS. 19 through 21, and the depending end portions 60, 60 of the elongated coiled tension spring extending downwardly at the underside of the modified two-piece door 150. When a dispensing activity is concluded and the receptacle employed is withdrawn from the paddle 38, actuator 45 will return to the first position as a result of the torsion spring 64 at the second arm 56 being released. At the same time, the depending end portions 60, 60 of the elongated coiled tension spring 51 also will be released, causing the depending end portions 60, 60 to engage the underside of the modified two-piece door 150, or the underside of a panel at which the door is mounted, and force the modified two-piece door to a position engaging the bottom of the ice delivery chute 23, thereby closing off passageway 48 to the dispensing of ice.

The actuating end portion 168 of the ice door positioning member 160 also includes an element 170 in the nature of a camming structure. The element 170 is operatively associated with a safety switch 172. The element 170 is arranged on the actuating end portion 168 in a manner such that when the ice door operator 120 is activated and the ice door positioning member 160 begins to rotate for the purpose of opening the modified two-piece ice door 150, the element 170 will rotate to a position activating the safety switch 172. Upon activation of the safety switch 172, the safety switch will deliver an electrical input signal to a controller described below that, in turn, will activate the auger motor for advancing ice from the ice bin of the ice maker 16 to the opening 18. This prevents ice from exiting the ice bin without the ice door being open which would create a backup of ice in the ice delivery chute 23. In addition, the auger motor also powers the crusher blades for crushing ice. If an individual should thrust his or her hand up through the opening 66 in the actuator 45, the element 170 will rotate to a position activating the switch 172, thereby providing an input to the controller that will result in the ice dispensing sequence being disabled. And that disablement will continue notwithstanding the subsequent advancement of the paddle 38 to an ice dispensing position and the actuation of an ice dispensing selector. Consequently, the ice crusher blades will not be able to be activated under those circumstances.

Figure 32:
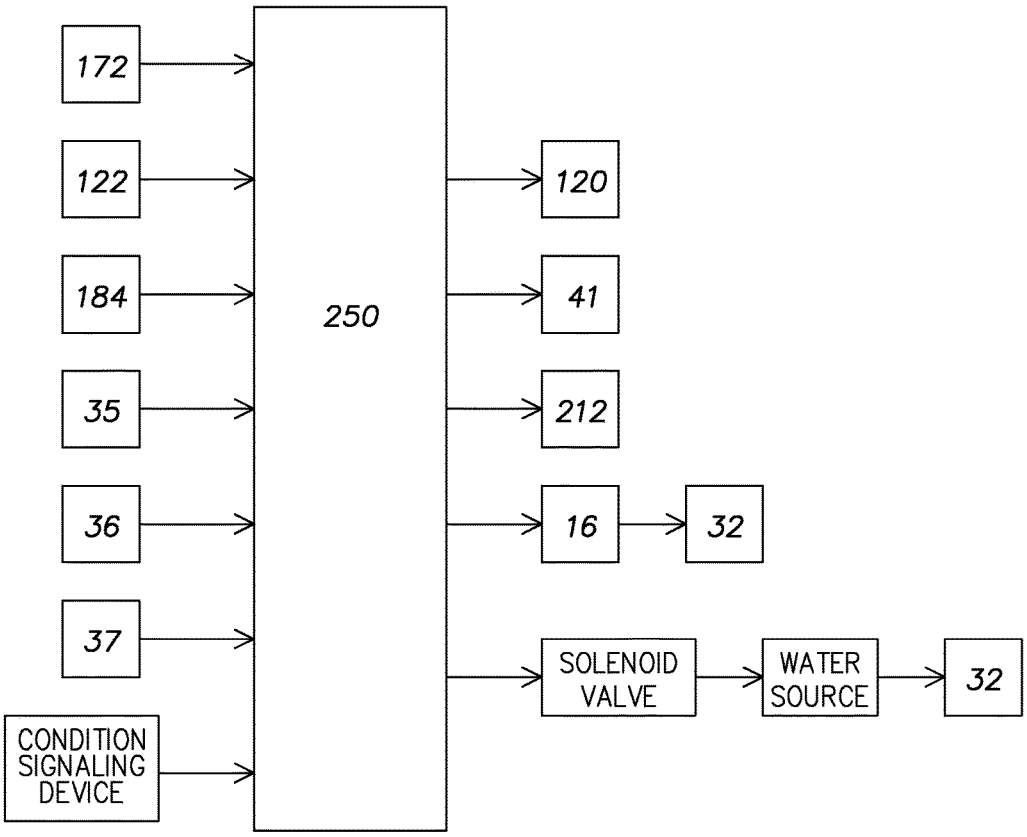
FIG. 32 is a schematic presentation of certain control features and elements applicable to the second aspect of the invention.

In order to provide for the selective dispensing of water and ice at the dispensing station of the refrigeration appliance a controller 250, referenced in FIG. 32, can be provided that is operably associated with the actuator 45, the water dispensing selector 35, the cubed ice dispensing selector 36 and the crushed ice dispensing selector 37. The controller also can be operably associated with additional components of the dispensing system as described below, including the water delivery system and the ice delivery system. The controller 250 causes water to be delivered from the refrigeration appliance 10 to and dispensed at the dispensing station 32 in response to the placement of the actuator 45 in the second position and the activation of the water dispensing selector 35, and ice to be delivered from the refrigeration appliance 10 to and dispensed at the dispensing station 32 in response to the placement of the actuator 45 in the second position, the activation of the water and ice actuating device 122 and the activation of one of the cubed ice dispensing selector 36 and crushed ice dispensing selector 37. The controller 250 also can cause both water and ice to be dispensed in the same receptacle by placing the actuator in the second position so as to activate the water and ice actuating device 122 and, thereafter, first activating one of the water dispensing selector, and an ice dispensing selector followed by the deactivation of the selector previously activated and the activation of the selector not previously activated.

According to a further aspect of the present invention, as illustrated in FIGS. 24 through 28, the nozzle 28 that is configured to direct a stream of water from a source of the water to a receptacle placed at the dispensing station 32 can comprise a nozzle that is movable between a retracted position and an extended position. In addition, as shown in FIGS. 29 and 30, the nozzle 28, located within the recess 22 at the dispensing station 32, is angularly adjustable from a substantially vertical position within the recess 22 to an inclined position from which the stream of water dispensed by the nozzle 28 can be directed towards the front of the recess, thereby facilitating the dispensing of water into a receptacle, such as a drinking bottle for example, that cannot readily be accommodated within the recess 22 and is more easily filled while being held outside the recess.

Figure 24:
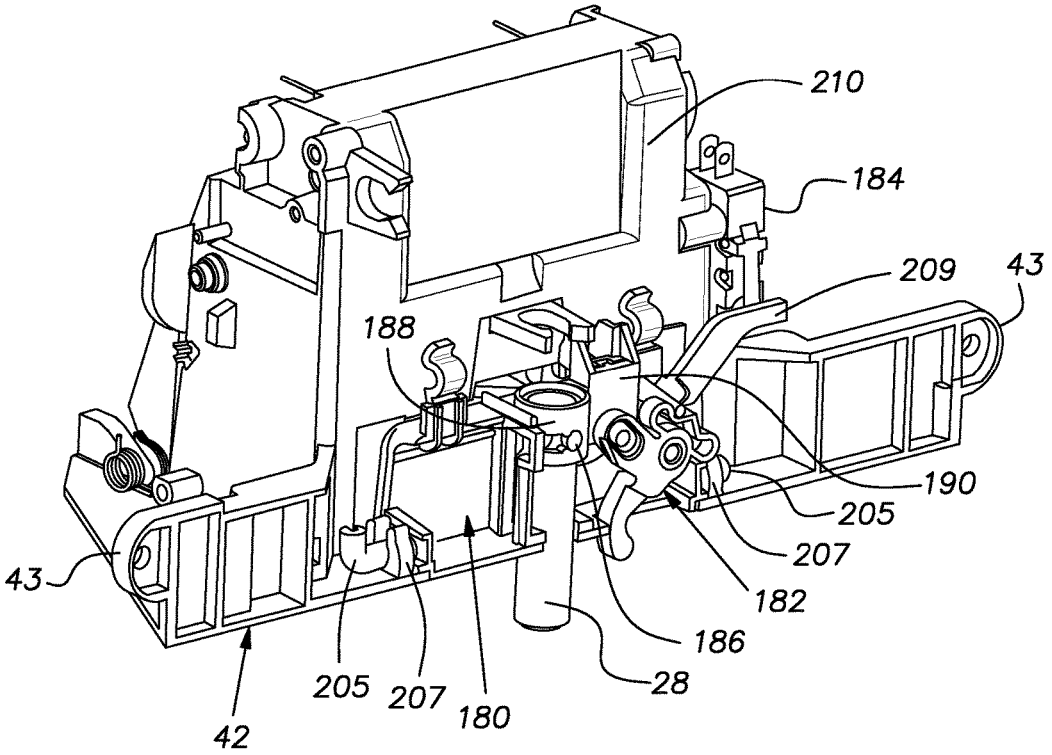
FIG. 24 is a perspective view of a dispensing unit that illustrates features associated with the operation of a water-dispensing nozzle according to one aspect.

As best seen in FIG. 24, a supporting structure 180 is shown as provided for supporting the nozzle 28, along with an actuating mechanism 182 that is configured, among other functions, to activate the delivery of the water to the nozzle when the nozzle is in the inclined position. In the example shown in FIG. 24, the nozzle 28 and the actuating mechanism 182 are shown to be supported by the supporting structure 180 at the bracket 42, with the nozzle being in fluid communication with a water conduit such as water conduit 26 as described above. The actuating mechanism 182 is operatively associated with the nozzle 28 for retracting the nozzle and extending the nozzle, for inclining the nozzle outwardly from the recess 22 of the dispensing station 32 and for activating an actuating switch 184 that causes water to be dispensed when the nozzle is in an inclined position.

Figure 25:
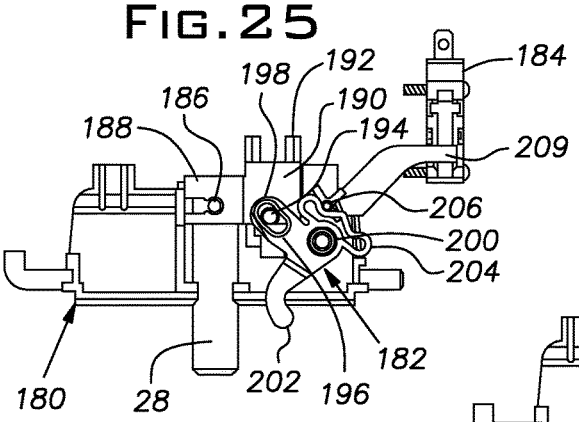
FIGS. 25 through 28 are front elevational views of the water-dispensing nozzle of FIG. 24 illustrating the nozzle in several operational states.

In FIGS. 25 through 28, the supporting structure 180 along with the actuating mechanism 182, the actuating switch 184 and the nozzle 28 are depicted as removed from the bracket 42. FIG. 25 illustrates the nozzle 28 in a retracted position, and FIG. 26 illustrates the nozzle in an extended position. As shown in these two figures, the nozzle 28 includes at its upper portion a retaining pin 186 by means of which the nozzle is held to a ring 188. Specifically, the ring 188 includes a retaining slot including a circular portion within which the retaining pin 186 resides when the retaining pin is in place at the ring 188 as can be seen in FIGS. 25 and 26 in a type of bayonet connection between the retaining pin and the ring. The ring 188 is attached to a vertically displaceable member 190 that is slidably mounted at slide member 192. Vertically displaceable member 190 includes a positioning pin 194 that projects outwardly from the supporting structure 180 through a positioning pin opening 196 that is located in an elongate portion 198 of the actuating mechanism 182.

The actuating mechanism 182 is pivotally mounted to the vertically displaceable member 190 at a pivot point 200 and includes a manipulating tab 202 that can be used to rotate the actuating mechanism 182 about the pivot point 200 for the purpose of extending and retracting the nozzle 28. As shown in FIG. 25, the manipulating tab 202 is located in a position adjacent the nozzle 28 when the nozzle is retracted upwardly at the supporting structure 180, and as shown in FIG. 26, the manipulating tab 202 is shown as having been moved to a position away from the nozzle so as to have extended the nozzle 28 downwardly from the supporting structure 180. The movement of the manipulating tab 202 by a user from a position adjacent the nozzle 28 to a position away from the nozzle and the concomitant counterclockwise rotation of the actuating mechanism 182 about the pivot point 200, as viewed in FIGS. 25 and 26, causes the positioning pin 194 attached to the vertically displaceable member 190 to be pulled downwardly by the associated downward movement of the elongate portion 198 of the actuating mechanism 182, thereby extending the nozzle 28 downwardly from the supporting structure 180. Conversely, the movement of the manipulating tab 202 by a user from a position away from the nozzle 28, as show in FIG. 26, to a position adjacent the nozzle, as shown in FIG. 25, and the concomitant clockwise rotation of the actuating mechanism 182 about the pivot point 200 as viewed in FIGS. 25 and 26, cause the positioning pin 194 attached to the vertically displaceable member 190 to be pulled upwardly by the associated downward movement of the elongate portion 198 of the actuating mechanism 182, thereby retracting the nozzle 28 to the supporting structure 180.

The actuating mechanism 182 also includes a positioning spring 204 that engages in one of two depressed positions a holding pin 206 that is fixed in place as shown in FIGS. 25 through 28. When the nozzle 28 is in the retracted position, as shown in FIG. 25, the holding pin 206 engages the positioning spring 204 at a first depressed position so as to retain the actuating mechanism 182 in an attitude wherein the nozzle 28 remains retracted unless the manipulating tab 202 is moved to the position at which the nozzle is extended. And when the nozzle 28 is in the extended position, as shown in FIG. 26, the holding pin 206 engages the positioning spring at a second depressed position so as to retain the actuating mechanism 182 in an attitude wherein the nozzle 28 remains extended unless the manipulating tab 202 is returned to the position at which the nozzle is retracted.

From time to time, it can be necessary or desirable to remove the nozzle 28 from the supporting structure 180 such as for the purpose for example of cleaning or replacing the nozzle. In that case the nozzle 28 is placed in an extended position and the nozzle is rotated so that the retaining pin 186 rotates in the retaining slot in which it is held in the ring 188, thereby releasing the connection between nozzle 28 and the ring 188 so that the nozzle can be removed from the supporting structure 180 as shown in FIG. 28.

As best seen in FIGS. 18 and 24, the supporting structure 180 is held at the bracket 42 by means of mounting arms 205, 205 that are held by means of clips 207, 207, whereby the bottom of the supporting structure 180, together with the lower portion of the nozzle 28, can be rotated away from the bracket 42. As a consequence, by grasping the nozzle 28 when it is in a substantially vertical position, as shown in FIG. 29 and pulling outwardly on the nozzle, the nozzle can be placed in an inclined position as shown in FIG. 30. Thereby, water dispensed from the nozzle 28 can be directed towards the front of the recess 22 so that receptacles held outside the recess can be filled. Consequently, a receptacle of essentially any size can be filled outside the recess when the nozzle is in the inclined position. Elements for returning the supporting structure 180 and the nozzle 28 to an upright position in the form of S-shaped spring members 208, 208 are located at the top of the supporting structure. Thus, when the bottom portion of nozzle 28 is pulled outwardly to the inclined position, the S-shaped spring members 208, 208 will come into engagement with the panel 210, which can comprise the back of the ice door, and will be placed under compression. When the nozzle 28 is released from its inclined position, the S-shaped spring members 208 will force the supporting structure 180 to an upright position as shown in FIG. 24.

For the purpose of causing water to be delivered to the nozzle 28 when it is in an inclined attitude as show in FIG. 30, the actuating switch 184 is provided. The actuating switch when actuated delivers an input signal to the controller 250 that in response to that input signal activates the water system so that water from the water source is delivered through the conduit 26 to the nozzle 28. The actuating switch 184 is located with respect to the nozzle and the associated components described above, as shown in FIGS. 25 through 30 such that when the nozzle 28 is placed in its inclined attitude, as shown in FIG. 30, an actuating arm 209 that is mounted to the supporting structure 180 is caused to rotated from a position away from the actuating switch 184 to a position engaging and activating the actuating switch.

In addition to the lighting system that involves the lighting elements 41, that are activated when the actuator 45 is placed in the second position in the embodiments described above, a supplementary lighting system can be provided that can illuminate the nozzle 28 in a manner indicating the status of an operating condition of a separate component of the refrigeration appliance 10. Thus, as shown in FIG. 31, at least one illuminating device, such as the two illuminating devices 212, 212, that can comprise LED lights for example, are mounted to the supporting structure 180 and are directed in a fashion to illuminate the nozzle 28. Each of the illuminating devices 212, 212 can be configured to produce a color light different from the color light produced by the other illuminating device and each of the illuminating devices can be operatively associated with a separate component of the refrigeration appliance, a condition concerning which the user wishes to be informed. For example, the refrigeration appliance 10 typically will include a water filter for the water that is dispensed at the dispensing station 32 and it can be useful to know when the water filter is in need of replacement. In that event, one of the illuminating devices 212 can be operatively associated with the water filter, whereby the illuminating device is energized when the water filter is in need of being replaced. For example, the water filter can include a signaling device for generating an electrical output signal that would cause one of the illuminating devices to light up and illuminate the nozzle 28 in an identifying selected color when the water filter is in need of being replaced.

Also by way of example, it can be desirable to know if one of the fresh food compartment or the freezer compartment has reached an undesirably high temperature as would result in the spoiling of food held in those compartments. In that case, the compartments can include a signaling device for generating an electrical output signal that would cause one of the illuminating devices to light up and illuminate the nozzle 28 in an identifying selected color when an undesirably high temperature has been reached.

As indicated above, the functioning of many of the components and elements described can be facilitated by the use of a controller or microprocessor, and this aspect of the invention is illustrated in FIG. 32. The inputs to the controller 250 can be provided by the following: safety switch 172; water and ice actuating device 122; actuating switch 184; water dispensing selector 35; cubed ice dispensing selector 36; crushed ice dispensing selector 37; and a refrigerator condition signaling device. And the outputs from the controller can be provided to the following: ice door operator 120; lighting elements 41; illuminating devices 212; ice maker 16; and a water source. Thus, it will be understood that the controller will function at least in part as follows: when the water and ice actuating device 122 and the water dispensing selector 35 are activated, the controller will cause the lighting elements 41 to be energized and the solenoid valve controlling water flow from the water source to open, resulting in the delivery of water to the dispensing station 32, after which the solenoid valve will close and the lighting elements 41 will turn off as the water and ice actuating device 122 is deactivated; when the water and ice actuating device 122 and the cubed ice dispensing selector 36 are activated, the controller will cause the lighting elements 41 to be energized, the ice door operator 120 to open the ice door with which it is operatively associated and the ice delivery mechanism at the ice maker 16 to be activated, after which the ice delivery mechanism will turn off, the ice door operator 120 will turn off and the lighting elements will turn off when the water and ice actuating device 122 is deactivated; when the water and ice actuating device 122 and the crushed ice dispensing selector 36 are activated, the controller will cause the lighting elements 41 to be energized, the ice door operator 120 to open the ice door with which it is operatively associated and the ice delivery mechanism at the ice maker 16, including the ice crusher, to be activated, after which the ice delivery mechanism will turn off, the ice door operator 120 will turn off and the lighting elements will turn off when the water and ice actuating device 122 is deactivated; when the actuating switch 184 is activated, the controller will cause the lighting elements 41 to be energized and the solenoid valve controlling water flow from the water source to open, resulting in the delivery of water to the nozzle 28 at the dispensing station 32, after which the solenoid valve will close and the lighting elements 41 will turn off as the actuating switch 184 is deactivated; when a refrigerator condition sensing device issues a signal to the controller, the controller will cause an appropriate one of the illuminating devices 212 to be lighted, after which the lighted illuminating device will turn off when the signal to the controller is turned off.

While the present invention has been described above and illustrated with reference to certain embodiments thereof, it is to be understood that the invention is not so limited. For example, the nozzle retracting, extending and removal features, and the refrigerator condition identifying feature illustrated in connection with the electromechanical ice-door opening mechanism, also can be employed with the mechanical ice-door opening mechanism. In addition, modifications and alterations of the aspects of the invention described herein will occur to those skilled in the art upon reading and understanding the specification, including the drawings. The present invention is intended to cover and include any and all such modifications and variations to the described embodiments that are encompassed by the following claims.

What is claimed is:

1. A dispensing unit operatively associated with a refrigeration appliance for selectively dispensing both water and ice at a dispensing station at the refrigeration appliance, the dispensing unit including:

a stationary bracket;

an actuator supported at the stationary bracket so as to be movable from a first position, at which first position the actuator does not support the dispensing of ice at the dispensing station, to a dispensing position, at which dispensing position the actuator supports the dispensing of at least ice at the dispensing station, the actuator including a passageway through which ice can be selectively dispensed through an ice dispensing opening of the passageway at the dispensing station, the ice dispensing opening being bounded in its entirety by the actuator;

an ice door operatively associated with the actuator and closing off the passageway to the dispensing of ice when the actuator is in the first position and opening the passageway to the dispensing of ice when the actuator is in the dispensing position;

an ice maker operatively associated with the actuator for delivering ice to the passageway of the actuator;

a safety switch operably associated with the actuator and the icemaker and configured to disable the dispensing of ice, including the operation of the icemaker, upon the thrusting upwardly of an object through the dispensing opening of the passageway;

a water dispensing selector for selecting water to be dispensed at the dispensing station when the actuator is in the dispensing position and the water dispensing selector has been activated; and an ice dispensing selector for selecting ice to be dispensed at the dispensing station when the actuator is in the dispensing position and the ice dispensing selector has been activated.

2. The dispensing unit of claim 1 including a controller operably associated with the actuator, the water dispensing selector and the ice dispensing selector and causing water to be dispensed at the dispensing station in response to an input signal indicating the placement of the actuator in the dispensing position and a concurrent input signal indicating the activation of the water dispensing selector and ice to be dispensed at the dispensing station in response to an input signal indicating the placement of the actuator in the dispensing position and a concurrent input signal indicating the activation of the ice dispensing selector.

3. The dispensing unit of claim 2 including a lighting system including at least one lighting element, the lighting system being operably associated with the actuator so that the placement of the actuator in the dispensing position energizes the lighting element.

4. The dispensing unit of claim 1 wherein the ice door includes:

a flapper having a seating surface configured to seat against the bottom of a chute through which ice is delivered to the passageway; and a flapper supporting member supporting the flapper, the flapper supporting member being joined to the flapper by a universal adjusting member, whereby the attitude of the flapper can be adjusted as the ice door engages the bottom of the chute so that the seating surface of the flapper seats against the bottom of the chute in a manner essentially entirely closing off the opening at the bottom of the chute to the passage of ice to the passageway.

5. The dispensing unit of claim 1 including a nozzle through which the water is dispensed and at least one illuminating device configured to illuminate the nozzle, each of the at least one illuminating device configured to produce a color light different from the color light produced by the other illuminating devices, and each color light representing an operating condition of a separate component of the refrigeration appliance.

6. The dispensing unit of claim 1 including a nozzle located within a recess at the dispensing station and configured to direct a stream of water within the recess, the nozzle being angularly adjustable from a substantially vertical position within the recess to an inclined position at which the stream of water dispensed by the nozzle is directed towards the front of the recess.

7. The dispensing unit of claim 1 wherein the dispensing unit and the dispensing station are included in a dispensing system that is operatively associated with the refrigeration appliance, the dispensing system also including:

a water delivery system operably associated with the refrigeration appliance and the dispensing station and configured to deliver water from the refrigeration appliance to the dispensing station; and an ice delivery system operably associated with the refrigeration appliance and the dispensing station and configured to deliver ice from the refrigeration appliance to the dispensing station.

8. The dispensing unit of claim 7 wherein:

a water dispensing selector operably associated with the water delivery system so as to selectively place the water delivery system in a water-delivery mode, the placement of the water delivery system in the water-delivery mode by the water dispensing selector, together with the placement of the actuator in the dispensing position, resulting in the delivery of water by the water delivery system from the refrigeration appliance to the dispensing station; and an ice dispensing selector operably associated with the ice delivery so as to selectively place the ice delivery system in an ice-delivery mode, the placement of the ice delivery system in the ice-delivery mode by the ice dispensing selector, together with the placement of the actuator in the dispensing position, resulting in the delivery of ice by the ice delivery system from the refrigeration appliance to the dispensing station.

9. The dispensing unit of claim 7 including a lighting system including at least one lighting element, the lighting system being operably associated with the actuator and a controller so that the placement of the actuator in the second operational state energizes the at least one lighting element.

10. The dispensing unit of claim 7 including a nozzle through which the water is dispensed and at least one illuminating device configured to illuminate the nozzle, each of the at least one illuminating device configured to produce a color light different from the color light produced by the other illuminating devices, and each color light representing an operating condition of a separate component of the refrigeration appliance.

11. The dispensing unit of claim 1 including an ice door operator operatively associated with the ice door and configured to cause the ice door to open the passageway to the dispensing of ice.

12. The dispensing unit of claim 1 wherein the ice door operator comprises a DC motor.

13. A dispensing unit operatively associated with a refrigeration appliance for selectively dispensing at least ice at a dispensing station at the refrigeration appliance, the dispensing unit including:

an actuator movable from a first position, at which first position the actuator does not support the dispensing of ice at the dispensing station, to a dispensing position, at which dispensing position the actuator supports the dispensing of at least ice at the dispensing station, the actuator including a passageway through which ice can be selectively dispensed through an ice dispensing opening of the passageway at the dispensing station, the ice dispensing opening being bounded in its entirety by the actuator;

an ice door operatively associated with the actuator and closing off the passageway to the dispensing of ice when the actuator is in the first position and opening the passageway to the dispensing of ice when the actuator is in the dispensing position;

an ice maker operatively associated with the actuator for delivering ice to the passageway of the actuator; and a safety switch operably associated with the actuator and the icemaker and configured to disable the dispensing of ice, including the operation of the icemaker, upon the thrusting upwardly of an object through the dispensing opening of the passageway, wherein the ice door is fixedly mounted to a rotating member that upon rotation causes the ice door to move between closing off the passageway and opening the passageway, the rotating member being mechanically operatively associated with the safety switch so as to cause the safety switch to disable the dispensing of ice, including the operation of the icemaker, upon the thrusting upwardly of an object through the dispensing opening of the passageway resulting in the rotation of the rotating member at the safety switch.

14. The dispensing unit of claim 13 wherein the ice door is fixedly mounted to the rotating member by at least one mounting bracket.

15. The dispensing unit of claim 14 wherein the at least one mounting bracket is operatively associated with the actuator and causes the rotating member to rotate and move the ice door between closing off the passageway and opening the passageway when the actuator is moved from the first position to the dispensing position.

16. A dispensing unit operatively associated with a refrigeration appliance for selectively dispensing at least ice at a dispensing station at the refrigeration appliance, the dispensing unit including:

an actuator movable from a first position, at which first position the actuator does not support the dispensing of ice at the dispensing station, to a dispensing position, at which dispensing position the actuator supports the dispensing of at least ice at the dispensing station, the actuator including a passageway through which ice can be selectively dispensed through an ice dispensing opening of the passageway at the dispensing station;

an ice door operatively associated with the actuator and closing off the passageway to the dispensing of ice when the actuator is in the first position and opening the passageway to the dispensing of ice when the actuator is in the dispensing position;

an ice maker operatively associated with the actuator for delivering ice to the passageway of the actuator; and a safety switch operably associated with the actuator and the icemaker and configured to disable the dispensing of ice, including the operation of the icemaker, upon the thrusting upwardly of an object through the dispensing opening of the passageway, wherein the ice door is fixedly mounted to a rotating member that upon rotation causes the ice door to move between closing off the passageway and opening the passageway, the rotating member being mechanically operatively associated with the safety switch so as to cause the safety switch to disable the dispensing of ice, including the operation of the icemaker, upon the thrusting upwardly of an object through the dispensing opening of the passageway resulting in the rotation of the rotating member at the safety switch.

17. The dispensing unit of claim 16 wherein the dispensing unit is operatively associated with the refrigeration appliance for selectively dispensing both water and ice at the dispensing station and the dispensing unit includes:

a water dispensing selector for selecting water to be dispensed at the dispensing station when the actuator is in the dispensing position and the water dispensing selector has been activated; and an ice dispensing selector for selecting ice to be dispensed at the dispensing station when the actuator is in the dispensing position and the ice dispensing selector has been activated.

18. The dispensing unit of claim 17 including a controller operably associated with the actuator, the water dispensing selector and the ice dispensing selector and causing water to be dispensed at the dispensing station in response to an input signal indicating the placement of the actuator in the dispensing position and a concurrent input signal indicating the activation of the water dispensing selector and ice to be dispensed at the dispensing station in response to an input signal indicating the placement of the actuator in the dispensing position and a concurrent input signal indicating the activation of the ice dispensing selector.

19. The dispensing unit of claim 18 including a lighting system including at least one lighting element, the lighting system being operably associated with the actuator so that the placement of the actuator in the dispensing position energizes the lighting element.

* * * * *